United States Patent [19]

Holland

[11] Patent Number: 4,778,355

[45] Date of Patent: Oct. 18, 1988

[54] WELL PUMP SYSTEM

[75] Inventor: John H. Holland, Norman, Okla.

[73] Assignee: John and Martin Holland and Associates Limited Partnership, Norman, Okla.

[21] Appl. No.: 906,260

[22] Filed: Sep. 11, 1986

Related U.S. Application Data

[63] Continuation-in-part of Ser. No. 615,300, May 30, 1984, Pat. No. 4,611,974.

[51] Int. Cl.[4] ..... F04B 47/00

[52] U.S. Cl. ..... 417/378; 417/388; 417/390; 417/546

[58] Field of Search ..... 417/377, 383, 385, 386, 417/387, 388, 378, 390, 397, 546; 40/372

[56] References Cited

U.S. PATENT DOCUMENTS

| | | | |
|---|---|---|---|
| 2,079,996 | 5/1937 | Humason | 417/378 X |
| 2,169,703 | 8/1939 | Mason | 417/390 |
| 3,123,007 | 3/1964 | Orr | 417/383 |
| 3,175,512 | 3/1965 | Sutliff | 417/546 |
| 4,174,928 | 11/1979 | Austin | 417/397 |
| 4,462,763 | 7/1984 | MacLeod | 417/378 |
| 4,540,348 | 9/1985 | Soderberg | 417/383 |
| 4,553,910 | 11/1985 | Gosschalk | 417/378 |

*Primary Examiner*—Leonard E. Smith

*Attorney, Agent, or Firm*—Hubbard, Thurman, Turner & Tucker

[57] ABSTRACT

A downhole well pump system comprises a reciprocating piston pump disposed in a fluid conduit in a wellbore which is filled with a driving fluid having a density preferably greater than the production fluid being pumped. The pump cylinder has a transverse partition and a piston assembly including an elongated piston rod extending through the partition and connected at its opposite ends to spaced apart pistons. The pump pistons and the cylinder partition divide the cylinder into a production fluid intake chamber, a production fluid transfer and delivery chamber, a driving fluid chamber and a second production fluid delivery chamber. Production fluid is conducted to the surface through a production fluid conduit disposed coaxial within the driving fluid conduit. A power transfer apparatus includes opposed cylinders and an opposed piston assembly interconnected by a common piston rod forming opposed production fluid and driving fluid chambers wherein the fluids are oscillated by the power transfer apparatus in the respective conduits and a net delivery of production fluid is conducted to a production fluid delivery line. Opposed hydraulic fluid chambers in the power transfer apparatus are connected to a reversible hydraulic pump. Pump driving fluid may be biased by an accumulator formed in the driving fluid conduit or in an accumulator cylinder connected to the pump in a modified version of the system which eliminates the driving fluid conduit. Embodiments of the pump system include mechanical rod actuated pumps which are operated on a lifting stroke by the column of production fluid.

39 Claims, 14 Drawing Sheets

WELL PUMP SYSTEM

CROSS REFERENCE TO RELATED APPLICATION

This application is a continuation-in-part of U.S. Application Ser. No. 615,300 filed on May 30, 1984, now U.S. Pat. No. 4,611,974.

BACKGROUND OF THE INVENTION

1. Field of the Invention

The present invention pertains to a well pump system for producing well fluids. The pump system includes a reciprocating piston downhole pump which utilizes the pressure of a column of hydraulic driving fluid or a gas over liquid accumulator and a column of production fluid for driving the pump. One embodiment uses a mechanical actuating rod and production fluid pressure for driving the pump. The driving fluid may be displaced by a hydraulically driven cylinder and piston type power transfer unit on the surface.

2. Background

In the art of downhole pumps for lifting fluids from wells and other subterranean reservoirs there are several concepts which have been relatively well developed including the so-called sucker rod type pump which comprises a reciprocating piston pump disposed deep in the well at the point from which fluid is to be pumped and which is actuated from the surface solely by an elongated reciprocating rod string. There have also been several developments in downhole well pumps which are hydraulically operated in an effort to overcome some of the disadvantages of the mechanical rod type pump. Typically, prior art hydraulically operated pumps, sometimes known as power oil pumps, comprise a reciprocating piston pump located in the wellbore and having opposed pistons or piston surfaces defining power oil chambers and production fluid chambers, respectively. Hydraulic or "power" oil is pumped down the well through a suitable conduit connected to the reciprocating piston pump for actuating the pump to deliver a charge of production fluid through a delivery line to the surface. In some types of power oil pumps the power oil is mixed with the production fluid in the delivery line as a means of returning the power oil to the surface. Accordingly, this so-called power oil must be suitably treated before it can be recirculated by the power oil delivery pump back to the well pump for further energization of the well pump. This type of hydraulically operated pump is relatively complicated and requires expensive and troublesome filtering systems for treating the fluid which is used as "power" oil. Other types of hydraulically operated pumps have been developed which provide separate delivery and return conduits for the hydraulic "power oil" and, of course, a third conduit is required for the production fluid.

Those skilled in the art will appreciate that the prior art hydraulically operated pumps which utilize either mixed production and power oil or separate closed loop power oil systems can be relatively inefficient. The power oil must be circulated down the hole and returned requiring relatively complex conduit systems, in the case of a separate or isolated power oil circuit, and the circulation of mixed or separate power oil completely down through the supply conduit and through the return conduit results in frictional losses which increase the overall power requirements for a given quantity of production fluid produced. Prior art pumps are also characterized by designs which lift production fluid on both strokes of the pump thereby complicating the pump structure itself.

Known types of well pumping systems also suffer from certain shortcomings such as the inability to be effectively regulated to pump at the desired production rate of the well. In this regard, known types of pumping systems are also at a disadvantage because of the economics of producing from low production or marginal wells, particularly wells for producing petroleum fluids. There must, of course, be economic justification for producing hydrocarbon fluids from subterranean wells. If the pumping costs and the capital equipment costs exceed the expected yield of the well or a low marginal net profit results there is little incentive to develop or produce from such formations and wells.

Accordingly, there has been an ongoing need for a downhole well pump which minimizes the capital equipment cost, may be inserted in a well without substantial modification to the existing well structure, may be inserted in wells which are deviated and cannot be produced using mechanical rod actuated pumps and which should be pumped at very low or variable rates to prevent overpumping the well and damaging the formation characteristics as well as the pump mechanism.

There has also been a need for an improved well pump system which can be conveniently installed in existing wells which are relatively inaccessible or for various reasons cannot be pumped utilizing equipment which extends above the earth's surface at the wellhead or takes up a great deal of room at the wellhead.

Substantially all of the disadvantages of known types of downhole well pump systems have been overcome with the hydraulically operated and combined mechanical and hydraulically operated pump system of the present invention as will be appreciated by those skilled in the art upon reading the following.

SUMMARY OF THE INVENTION

The present invention provides an improved downhole pump system including a reciprocating piston type downhole pump which includes a piston assembly dividing the pump cylinder into pump driving fluid and pump production fluid chambers and wherein the pump is actuated utilizing the forces exerted on the piston assembly by standing columns of pump driving fluid and pump production fluid.

In accordance with the invention pump systems are provided wherein the driving fluid is maintained at a working pressure by a gas charged accumulator for maintaining a substantially constant pressure on the driving fluid. The accumulator may be formed as part of the driving fluid conduit and supplied with pressure gas at a regulated pressure. In one embodiment of the pump system the driving fluid conduit is eliminated and the gas charged accumulator is formed as part of an extension of the pump housing which is preferably arranged to interconnect the downhole pump unit with a production fluid delivery conduit from which the pump is suspended in a well. Pump production fluid is displaced by modified power transfer unit disposed on the surface and driving fluid is contained within the pump housing. The accumulator portion of the pump housing is precharged with pressure gas prior to insertion of the pump into the wellbore.

In accordance with one aspect of the present invention there is provided a well pump system wherein a substantially standing column of pump driving fluid is oscillated or reciprocated in a conduit within the well between a power transfer unit on the surface at the wellhead and a reciprocating piston pump disposed in the well at the depth desired for producing production fluid. The downhole well pump is provided with a cylinder divided into at least one production fluid chamber and one driving fluid chamber by a reciprocable piston which is reciprocated by pressure fluid forces exerted thereon by the driving fluid and the production fluid. In one embodiment of the pump the pump piston comprises a piston assembly having two piston members interconnected by an elongated tubular piston rod and the cylinder is provided with a fixed partition through which the piston rod extends to form at least two interconnected production fluid chambers and a driving fluid chamber formed between one of the pistons and the cylinder partition. In another embodiment, primarily used for low production wells, a single reciprocable piston includes opposed piston rod portions extending through cylinder partitions to form driving and production fluid chambers.

In accordance with another aspect of the invention the pump is adapted to be driven through a production fluid delivery stroke by driving fluid which is disposed in a standing column formed by a well conduit. Driving fluid is displaced from a driving fluid chamber of a power transfer unit, preferably disposed on the surface at or near the wellhead, or by fluid pressure imposed on the driving fluid from a pressure regulated source. During a pump delivery stroke production fluid is displaced from the production fluid chambers of the pump and during an intake or suction stroke driving fluid is displaced from the driving fluid chamber of the pump by a pressure force exerted on the piston by production fluid in one of the production fluid chambers while a fresh charge of production fluid is drawn into the second production fluid chamber of the pump.

In accordance with yet another aspect of the present invention there is provided a hydraulically operated well pump system wherein production fluid and driving fluid are maintained isolated from each other through a coaxial conduit system in the well including, in one embodiment, conventional well production tubing in which the downhole pump is inserted and positioned at the desired depth for operation and wherein the downhole pump is supported in the well at one end of the well tubing by a pump head portion and wherein the pump is held in position by the weight of a production fluid delivery conduit connected to one end of the pump. Pump driving fluid is disposed in the outer conduit in a standing column and which fluid is oscillated in the column to effect operation of the pump. Accordingly, pumping losses of the driving fluid are minimized and the entire quantity of driving fluid utilized is not required to be handled at the surface or treated prior to reinjection into the well as with certain prior art hydraulically operated well pumps.

The coaxial arrangement of the driving fluid conduit and the production fluid conduit minimizes problems associated with handling the pump for insertion into and withdrawal from the well, which together with unique vent valves formed between the production fluid conduit and the pump body and between the pump body and the driving fluid conduit, respectively, permit withdrawal of the pump assembly from the well in a so-called dry condition without leaving production or driving fluid in the conduits as they are extracted from the well.

The present invention also provides an improved hydraulically operated pump system for a downhole hydraulic pump having a unique power generating or transfer apparatus which is relatively compact, has a low physical profile or envelope and is adapted to be mechanically or hydraulically actuated for oscillating the driving fluid column and for effecting delivery of a net amount of production fluid with each stroke of the downhole pump. In certain embodiments of the power transfer apparatus there is provided a cylinder member having a piston assembly disposed therein and dividing the cylinder into opposed production fluid and driving fluid chambers. Production fluid is drawn into and through the production fluid chamber during a delivery stroke of the downhole pump and driving fluid is displaced from the power transfer apparatus to drive the downhole pump piston through its delivery stroke. During a return stroke of the power transfer piston assembly driving fluid is transferred into the driving fluid chamber of the power transfer apparatus and at least a portion of production fluid displaced from the production fluid chamber of the downhole pump is returned to the downhole pump to move the pump through a charging stroke wherein a pump production fluid delivery or transfer chamber is recharged.

In accordance with still another aspect of the present invention a power transfer apparatus is provided for a hydraulically operated downhole pump comprising a horizontally opposed reciprocating piston mechanism having a first piston disposed in a first cylinder and dividing the cylinder into a pump driving fluid transfer chamber and a production fluid transfer and delivery chamber or, alternatively, an inert charge fluid chamber. The first piston is connected to a second opposed piston which is disposed in a second cylinder isolated from the first cylinder and dividing the second cylinder into opposed hydraulic power fluid chambers which are operable to receive power fluid alternately from a hydraulic power source. The power transfer apparatus may also be provided with a third cylinder opposed to the second cylinder and provided with a third piston aligned with and connected by a common rod to the first and second pistons and forming the driving fluid chamber and an inert charge fluid chamber to isolate the respective power fluid chambers from the production and driving fluid chambers.

Further in accordance with an embodiment of the power transfer apparatus, the hydraulic power source comprises a positive displacement reversible hydraulic pump which is operable to alternately deliver hydraulic fluid to the opposed power fluid chambers. The power transfer apparatus is preferably arranged with a horizontal balanced opposed reciprocating piston assembly which requires minimum foundation structure and provides a low dimensional profile. The power transfer apparatus may be easily disposed below ground level for aesthetic or functional reasons. Moreover, the power transfer apparatus may be adapted for other pumping applications.

In accordance with yet a further aspect of the present invention there is provided a downhole hydraulically operated well pump which is of relatively uncomplicated construction and is provided with a reciprocable double piston disposed in a cylinder in such a way as to provide two spaced apart production fluid transfer and delivery chambers, a production fluid inlet chamber and a pump driving fluid chamber. The pump is adapted to be disposed in a well conduit such as conventional oil well production tube and is adapted to be lowered to its working position on the distal end of a production fluid delivery conduit.

The improved downhole pump of the present invention is also characterized by an arrangement of one way flow control valves disposed in one of the pistons and in a hollow piston rod interconnecting the opposed pistons to provide for delivery of production fluid from two separate chambers in the pump during a delivery stroke of the piston assembly together with filling of a production fluid intake chamber. The flow control valve arrangement also provides for improved volumetric efficiency by minimizing the residual quantity of production fluid subject to compression during a charging or fluid transfer stroke of the pump piston assembly. The pump may be provided in a dual delivery chamber configuration or a triple delivery chamber configuration.

The downhole pump advantageously utilizes a disposable hydraulic fluid which may be of higher density than the production fluid, such as water, and maintains the driving fluid isolated from the production fluid. The power transfer apparatus also isolates the hydraulic power fluid from both the downhole pump driving fluid and the production fluid.

One embodiment of the pump system uses a mechanical actuating or sucker rod string for reciprocating the pump piston assisted by a pressure force exerted on the piston by the column of production fluid to reduce the rod uplift actuating effort.

The pump system of the present invention is particularly adapted for widely variable pumping rates as controlled by the power transfer apparatus whereby the delivery of production fluid from a particular well may be controlled in accordance with well characteristics. The pressure of well production fluid in the wellbore at the downhole pump inlet can be utilized to assist in pump operation and control the pumping rate if, for example, production fluid pressure should decline in the wellbore. The downhole pump may be utilized in conjunction with conventional oil well production fluid tubing and may be inserted through such tubing in virtually any type of well in which the tubing can be inserted. The pump may be inserted on the end of a fluid delivery conduit which can be a continuous tube which is injected into and withdrawn from the well using conventional, so-called coiled tubing injector equipment.

The above-noted features and advantages of the present invention as well as additional superior aspects thereof will be further appreciated by those skilled in the art upon reading the detailed description which follows in conjunction with the drawing.

DESCRIPTION OF THE PREFERRED EMBODIMENTS

Figure 1:
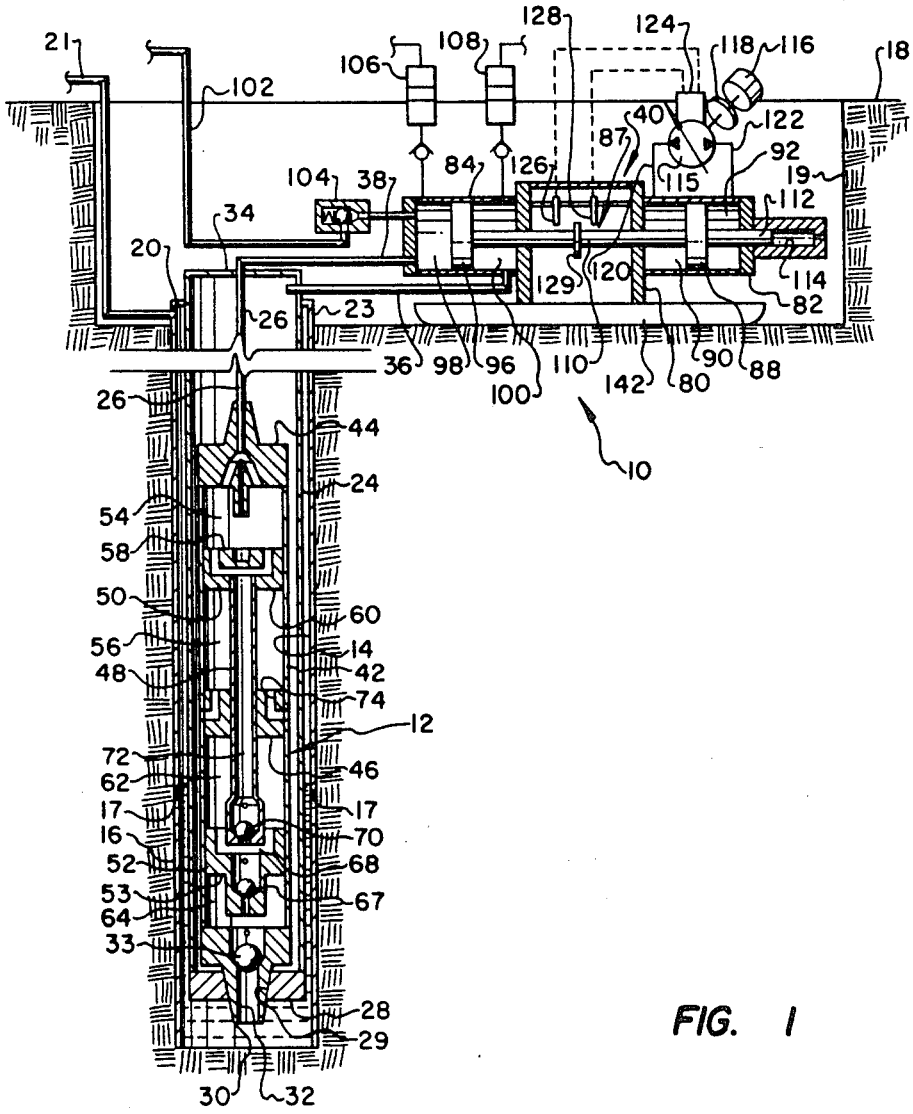
FIG. 1 is a diagram, in somewhat schematic form, of the hydraulically operated well pump system of the present invention.

In the description which follows like parts are marked throughout the specification and drawing with the same reference numerals, respectively. The drawing figures are not necessarily to scale and certain features of the invention have been shown exaggerated in scale or in schematic or diagrammatic form in the interest of clarity and conciseness.

Referring to FIG. 1, there is illustrated in somewhat schematic form a unique hydraulically operated well pumping system in accordance with the present invention and generally designated by the numeral 10. The pumping system 10 includes a downhole pump 12 adapted to be inserted in a wellbore 14. The wellbore 14 may be a cased or uncased well and for the sake of description herein will be indicated to have a casing 16 which has been suitably perforated at 17 to allow subterranean formation fluids to flow into the wellbore 14. The casing 16 may extend substantially to the earth's surface 18 as provided by a shallow pit 19 and be capped at 20 to form a wellhead 23. Suitable conduit means 21 are provided below or above the surface 18 for pressurizing the wellbore 14 and/or for conducting gas away from the wellbore, if required.

The pumping system 10 also includes an arrangement of coaxial conduits comprising an outer driving fluid conduit 24 and an inner production fluid conduit 26 which is arranged preferably coaxially within the driving fluid conduit. The driving fluid conduit 24 is preferably provided at its lower end with an end cap 28 having a central bore 29 through which a tapered bottom head portion 30 of the pump 12 projects and forms a fluid inlet port 32. The conduit 24 may, in fact, be characterized as conventional so-called production tubing typically used for producing hydrocarbon fluids from subterranean wells. The conduit 24 may extend to the surface and is provided with a cap 34 to form a closed conduit. The conduit 24 may, in fact, terminate in a typical wellhead apparatus, not shown, including the upper end of the casing 16. The aforementioned wellhead apparatus is not believed to require illustration in detail in order to understand and practice the present invention. The production fluid conduit 26 typically extends through the end cap 34 of the driving fluid conduit 24 and both the driving fluid conduit and the production fluid conduit include respective conduit extension portions 36 and 38 which lead to a power transfer apparatus for the pumping system 10, and which is generally designated by the numeral 40.

Figure 2:
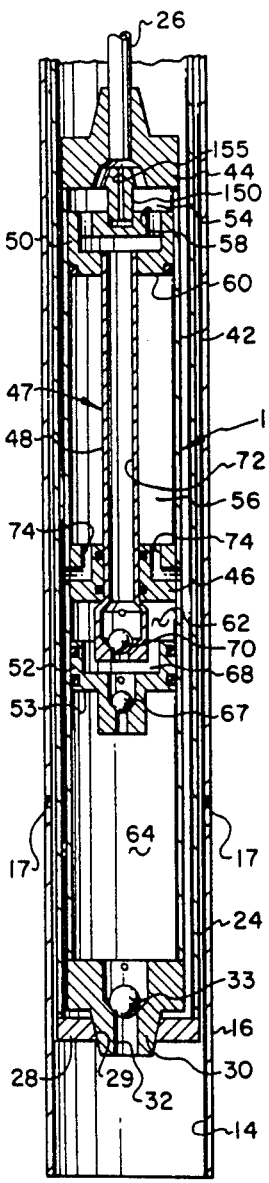
FIGS. 2 through 5 illustrate the downhole pump of the present invention in various positions in an operating cycle.

Referring to FIGS. 1 and 2, the downhole pump 12 is further characterized by an elongated cylindrical housing 42 which is closed at one end by the head part 30 and at the other end by a second head part 44 connected to the production fluid conduit 26. The housing 42 includes a partition 46 formed therein and through which extends an elongated tubular piston rod 48 which is connected at its upper end to a first piston 50 and the lower end of the piston rod 48 is connected to a second piston 52. The first piston 50 is slidably disposed in the housing 42 and divides the housing into a production fluid transfer chamber 54 and a driving fluid chamber 56. Accordingly, production fluid acts downwardly on a piston face 58 and driving fluid may be admitted to the chamber 56 to act upwardly on the opposite piston face 60 of the piston 50. The chamber 54 operates to transfer production fluid from a chamber 62 on an upstroke of piston assembly 47 and functions as a production "power" fluid chamber on a piston downstroke.

The piston 52 divides the lower end of the housing 42 into the production fluid delivery chamber 62 and a production fluid intake chamber 64 which is operable to be in communication with the wellbore 14 through the intake port 32. The piston assembly 47, comprising the tubular rod 48 and the spaced pistons 50 and 52, is provided with passage means for conducting production fluid from the chamber 64 to the chambers 54 and 62 as well as passage means for conducting production fluid from the chamber 62 to the chamber 54. A ball type one way or check valve 67 is supported by the piston 52 and interposed in a passage 68 which interconnects the chambers 64 and 62. A second ball type check valve 70 is interposed between a passage 72 in the piston rod 48 and the chamber 62. A third ball type check valve 33 may be provided, as shown, interposed in the port 32 and operable for admitting production fluid from wellbore 14 to the chamber 64.

In response to an upward movement of the piston assembly 47 toward head 44 production fluid is simultaneously displaced from chamber 62 and chamber 54 into the production fluid conduit 26 toward the power transfer apparatus 40 under the urging of pressure fluid admitted to the driving fluid chamber 56 through passages 74 in the partition 46. the passages 74 open through the housing 42 and are operable to communicate the chamber 56 with the interior of the driving fluid conduit 24 at all times. Thanks to the substantial fluid pressure exerted on the piston face 60 by a standing column of fluid in the driving fluid conduit 24, the piston assembly 47 may be driven through a fluid delivery stroke, during which the check valve 67 is closed and the check valve 70 is open, whereby production fluid is transferred out of the chamber 62 and the chamber 54 toward the power transfer apparatus 40. During a production fluid delivery stroke check valve 33, if used, opens to admit production fluid from wellbore 14 to chamber 64. The pressure of a standing column of production fluid in the wellbore 14 may be sufficient to act on piston face 53 to assist in driving the piston assembly 47 through a production fluid delivery stroke.

The standing columns of fluid in the conduits 24 and 26 are considered to be essentially of the same length, so that the fluid pressures acting on the pump piston 50 due to fluid in the conduits 24 and 26 depend on respective fluid densities. The face areas 58 and 60 of the piston 50 may be selected in combination with the respective densities of the production fluid and the driving fluid such that a net resultant force due to the pressure of the fluid columns acting on the piston assembly 47 will cause the piston assembly 47 to be balanced, biased towards the completion of an upward delivery stroke or towards the completion of a downward intake or fluid transfer stroke, respectively, as well conditions might require. In the pump system 10 water may be used as the driving fluid, having a density which may be greater than the well fluid. The opposed piston face areas of piston 50 may be selected such that when the production fluid conduit 26 is filled with production fluid and the conduit 24 is filled with driving fluid the piston assembly 47 is balanced, if desired, or biased downward, viewing FIG. 1, to maximize the volume of the chambers 54 and 62. Moreover, the upward bias force on the piston assembly 47 can be controlled in accordance with a predetermined pressure to be maintained in wellbore 14 and acting on piston face 53.

The power transfer apparatus 40 is characterized by a frame 80 supporting horizontally opposed cylinder members 82 and 84. The cylinder 82 is provided with a cylindrical bore in which a piston 88 is disposed and divides the bore into opposed meter chambers 90 and 92. The cylinder 84 is also provided with a cylindrical bore in which is disposed a piston 96 dividing the bore into a production fluid chamber 98 and a driving fluid chamber 100. The driving fluid conduit 24, 36 is in communication with the chamber 100 and the production fluid delivery conduit 26, 38 is in communication with the chamber 98. A production fluid delivery conduit 102 is also in communication with the chamber 98 and has a minimum pressure valve 104 interposed therein for maintaining a minimum pressure in the chamber 98 in response to reciprocation of the piston 96 to scavenge the chamber 98. The delivery conduit 102 may be connected to a suitable reservoir, not shown, or other means for receiving production fluid from the wellbore 14. The chambers 98 and 100 may be maintained at a predetermined minimum pressure by accumulators 106 and 108, respectively, for maintaining a predetermined minimum pressure of the production fluid and the driving fluid so as to negate any adverse effects resulting from compressibility of the respective fluids in particularly deep wells. The accumulators 106 and 108 may be connected to respective sources of pressure fluid, not shown, at controllable pressures. The compressibility of the production and driving fluids themselves may serve the accumulator function with an initial charge pressure applied to the fluid columns and considering elastic expansion of steel or similar metal tubing used for the conduits 24 and 26.

The pistons 88 and 96 are preferably arranged coaxial with each other in their respective cylinders and are interconnected by a piston rod 110 supported for sliding movement on the frame 80 to form a piston assembly 87. The piston rod 110 includes an integral extension 112 received in a bore 114 of an extension of the cylinder 82 so that the opposed transverse faces of the piston 88 are of equal axial projected areas. The power transfer apparatus 40 is actuated by suitable means including a hydraulic pump 115 drivably connected to a suitable motor 116 through a flywheel 118. The fluid intake and delivery conduits 120, 122 of pump 115 are connected to the cylinder chambers 90 and 92 for delivering hydraulic fluid to the respective chambers in a cyclic manner to effect reciprocation of the piston assembly 87. The pump 115 may be of a type which is operable to reverse the direction of flow in the respective fluid conducting lines 120 and 122. Alternatively, the lines 120 and 122 could be in communication with a reversing valve between the pump 115 and the cylinder 82.

In accordance with an embodiment of the invention the pump 115 is of the so-called overcenter axial piston type wherein flow through the lines 120 and 122 may be reversed by actuation of a suitable pump controller 124 in response to signals received from suit-able control means such as spaced apart adjustable limit switches 126 and 128 which are engageable, respectively, by an actuator 129 mounted on piston rod 110. The relative positions of switches 126 and 128 on frame 80 may be adjusted to control the stroke length of the pistons 88 and 96 and, accordingly, the stroke of pump 12 by controlling the flow direction of fluid delivered by pump 115 to the respective chambers 90 and 92. Alternatively, the controller 124 may be mechanically interconnected with the piston rod 110 in such a way that, as the piston assembly 87 reaches a predetermined limit of a stroke in one direction, the pump controller 124 is actuated to reverse the direction of flow in the pump fluid lines 120 and 122 to reverse the direction of movement of the piston assembly 87. The pump 115 may be of a type manufactured by the Rexroth Corporation, Mobile Hydraulics Division, Wooster, Ohio as their type AA4V. This is a swashplate type variable displacement overcenter axial piston pump designed for closed circuit power transmission systems. Certain detailed features including filters, heat exchangers, and conventional pump controls are not shown in the diagram of FIG. 1 and are not believed to be necessary in order to enable one skilled in the art to practice the instant invention. Suffice it to say that the pump 115 is reversible in the sense that it is operable to effect reversal of hydraulic fluid flow in the conduits connected to the pump to effect reciprocation of the piston assembly 87.

Those skilled in the art will appreciate that the power transfer appartus 40 may be modifed to include other means for reciprocating the piston 96 although the hydraulic power source comprising the pump 115, motor 116, and flywheel 118 provides a particularly compact low profile apparatus which may be mounted on a suitable skid 142. Moreover, the apparatus 40 may be mounted remote from the wellbore 14 or may be disposed in pit 19 below the surface 18 for aesthetic and/or functional reasons depending on the location of the well in which the pumping system 10 is being used.

Referring now to FIGS. 2 through 5, a typical operating cycle of the pumping system 10 will be described. FIG. 2 shows the pump 12 in the maximum upstroke position wherein driving fluid has displaced the piston assembly 47 to sweep the chambers 54 and 62 of production fluid. The combined displacement volume of chambers 54 and 62 exceeds the displacement volume of chamber 98 by the volume of chamber 62, preferably. Accordingly, during an upstroke of the piston assembly 47 a net amount of production fluid equal to the volume of chamber 62 passes through chamber 98 and is delivered to line 102. In the position of pump 12 shown in FIG. 2 the power transfer apparatus piston assembly 87 would be displaced its maximum distance to the right, viewing FIG. 1. The direction of flow through the lines 120 and 122 is then reversed such that hydraulic fluid from the pump 115 is being supplied to the chamber 92 and scavenged from the chamber 90 whereby the piston assembly 87 will be moved leftward, viewing FIG. 1, to displace production fluid from the chamber 98 back into conduit 26. As production fluid is displaced from the chamber 98, driving fluid may flow from the conduit 24 into the chamber 100. The weight of the column of fluid in the production conduit 26 will effect movement of the piston assembly 47 downward, viewing FIG. 3, to expand the chambers 54 and 62.

As the pump 12 is moved through a stroke cycle to the position ilustrated in FIG. 2, production fluid in the wellbore 14 has flowed through port 32 into chamber 64 to substantially fill this chamber with production fluid. Accordingly, as the piston assembly 47 commences moving downward to the positions indicated in FIGS. 3 and 4, valve 33, if used, closes to prevent displacement of production fluid back into the wellbore 14 and valve 70 seats under the urging of fluid in chamber 54 and passage 72 as fluid in the conduit 26 returns into the chamber 54 to urge piston 50 downwardly. During the downstroke of piston assembly 47 valve 67 unseats to permit transfer of fluid from chamber 64 to chamber 62. Typically, the maximum displacement volume of chamber 64 is not substantially more than the maximum displacement volume of chamber 62, although if valve 33 is omitted this volume relationship is not significant. As the piston assembly 47 is moving downwardly driving fluid is displaced out of chamber 56 and upward through the conduit 24 and toward chamber 100.

Figure 4:
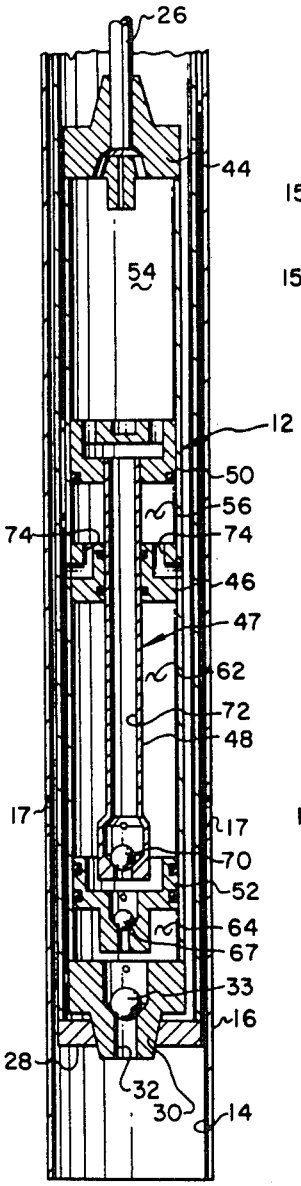

When the piston assembly 47 reaches the lower limit of its stroke as indicated by the position of the piston assembly in FIG. 4, the chambers 54 and 62 are filled completely with production fluid from conduit 26 and transferred from the intake chamber 64, respectively. At this point, the power transfer apparatus 40 has reversed the direction of movement of the piston assembly 87 to commence displacing driving fluid out of chamber 100, through the conduit 24 and into chamber 56 whereby the piston assembly 47 is now urged upward which effects closure of the valve 67. As the piston assembly 47 moves from the FIG. 4 position, through the FIG. 5 position and back to the FIG. 2 position production fluid is displaced from the chamber 62 through valve 70 and passage 72 and to chamber 54, and, simultaneously, production fluid is being dispalced from chamber 54 through the production delivery conduits 26 and 38 into and through the chamber 98 and into the production delivery line 102. During movement of the piston assembly 47 from the FIG. 4 position to the position of FIG. 2 chamber 64 will again fill with production fluid.

Figure 5:
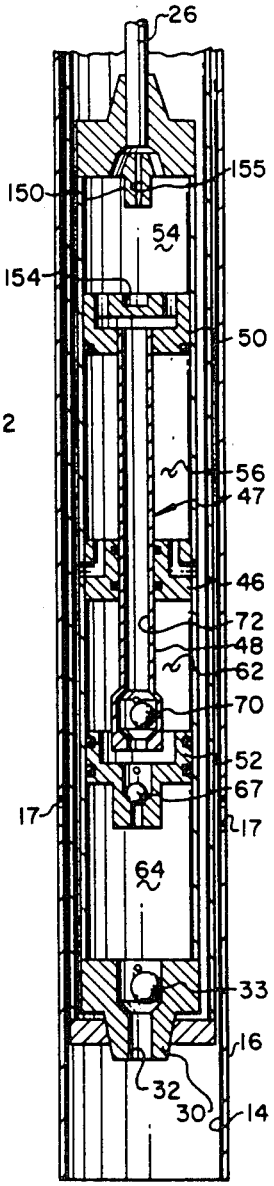

As the piston assembly 47 moves upward through the delivery stroke illustrated in FIG. 5 to the position illustrated in FIG. 2, the piston 50 will engage a hydraulic cushion forming means comprising a generally cylindrical projection 150 disposed in the chamber 54 and forming part of the head assembly 44. The projection 150 enters a chamber 154 formed in the face of the piston 50 whereby fluid trapped in the chamber 154 by the projection 150 is allowed to flow at a substantially throttled rate through a suitable passage 155 formed in the head 44.

Figure 3:
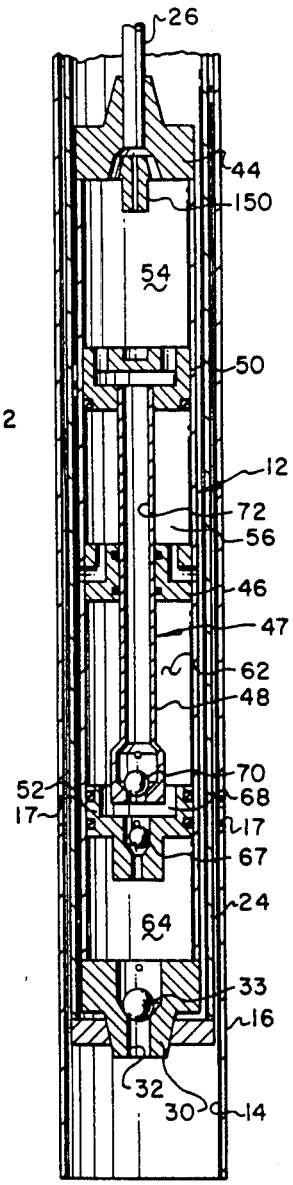

Accordingly, the pump 12 is operable to deliver a net quantity of production fluid comprising the displacement of the chamber 62 as the piston assembly 47 moves through a cycle from the position illustrated in FIG. 2 through the positions illustrated in FIGS. 3, 4 and 5 and back to the position illustrated in FIG. 2. This displacement takes place with relatively low frictional flow losses of the driving fluid since the fluid only oscillates over a very limited distance in a relatively large diameter, substantially unrestricted conduit. Moreover, depending on the density of the driving fluid in relation to the density of the production fluid and the selection of the effective axially projected areas of the piston faces 58 and 60, the pump piston assembly 47 may be biased in an upward or downward stroke limit position or balanced by the net resultant forces acting on the piston assembly. Of course, the height of the column of production fluid standing in the wellbore 14 is also operable to bias the piston assembly 47 upward through its action on the axially projected face area 53 of the piston 52. As previously mentioned, the power transfer apparatus 40 may be adapted to operate at a virtually infinitely variable rate whereby the piston assembly 47 may be stroked through a so-called suction and discharge stroke cycle at a rate which matches the desired rate of fluid delivery from the wellbore.

Although the height of the column of production fluid in the wellbore 14 results in a relatively low pressure on the piston face 53 pressure force acting on this face may be significant enough so that in conjunction with providing a pressure relief setting for the hydraulic fluid being discharged from the pump 115 through line 120, that during a cycle of the power transfer unit to force driving fluid into the chamber 56, if the pressure force urging the piston assembly 47 upwardly is not sufficient considering the total force exerted on the piston face 53 and piston face 60 pressure fluid being bypassed from the line 120 may be sensed as to flow or heat build up to shut down the pump 12 until pressure in the wellbore 14 again increases to a point sufficient to contribute to the lifting force on the piston assembly 47. In this way control of the pump rate of a well may be obtained without the danger of overpumping.

The use of the check valve 33 is dependent on the production fluid flow conditions into the wellbore 14. Typically, the displacement volume of chamber 64 is selected to be slightly greater than the displacement volume of chamber 62. The check valve 33 should be installed in applications of the pump 12 wherein a relatively high percentage of gases are dissolved in or entrained in the production fluid. Since pressure in the wellbore 14 acting on the check valve 33 effects opening of the valve on a downstroke of the piston assembly 47 use of the check valve 33 aids in preventing overpumping or so called gas lock of the pump. In wells with very high liquid content of the production fluid the check valve 33 is preferably omitted.

Figure 6:
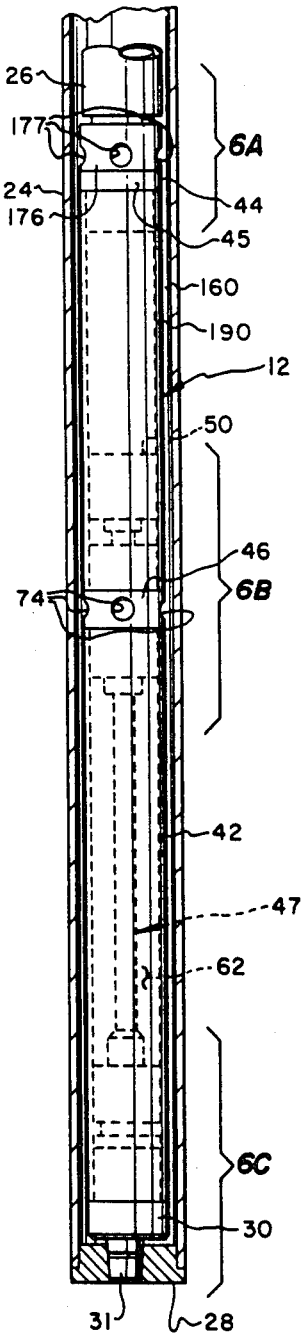
FIG. 6 is a longitudinal elevation view of the downhole pump inserted in a wellbore.
Figure 6A:
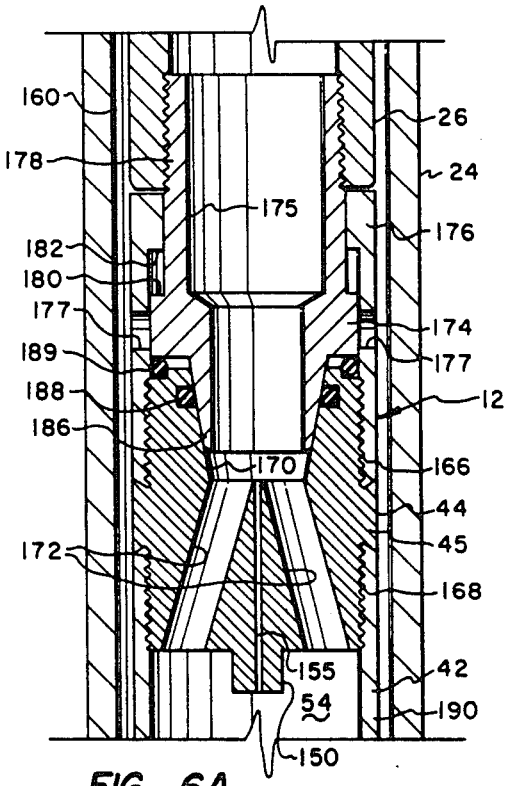
FIGS. 6A, 6B and 6C are partial longitudinal central section views of respective portions of the downhole pump as indicated in FIG. 6.
Figure 7:
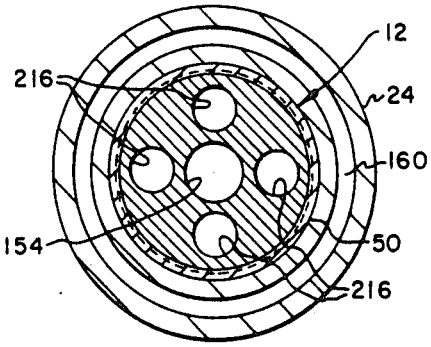
FIG. 7 is a section view taken along the line 7—7 of FIG. 6B.
Figure 6B:
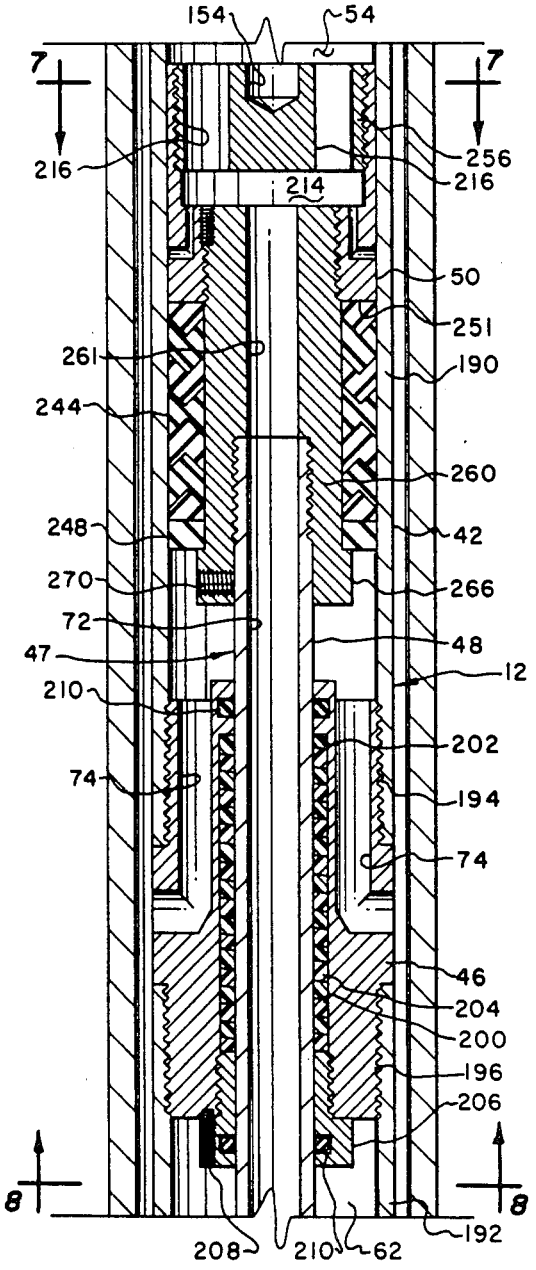
Figure 6C:
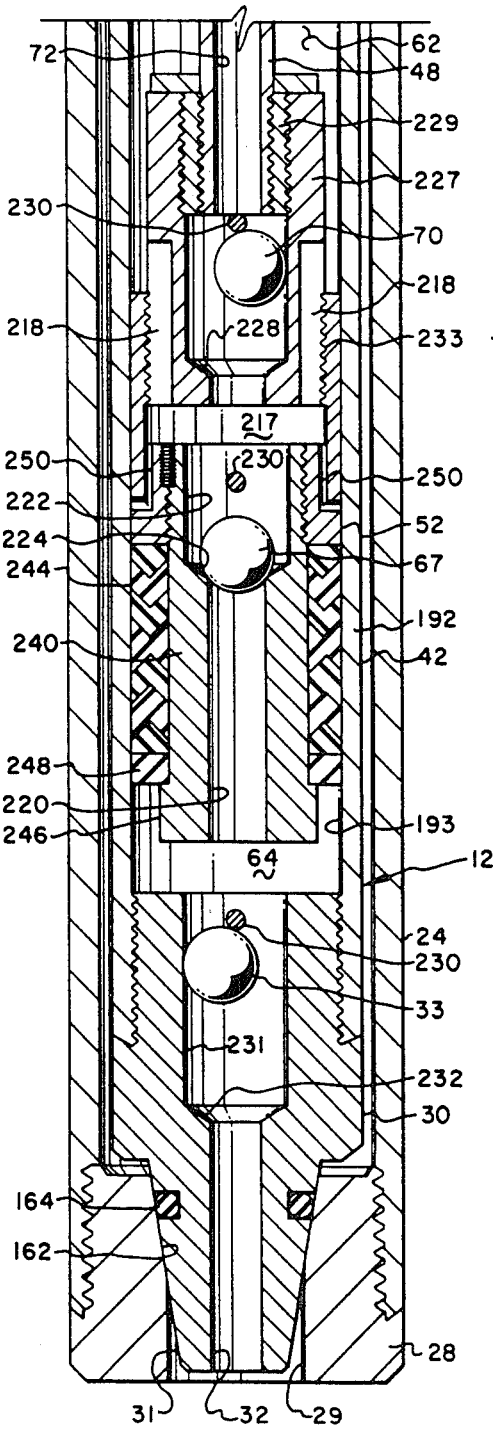

Referring now to FIGS. 6, 6A and 6C, the pump 12 is shown in FIG. 6 disposed in the lower end of the driving fluid conduit 24 in fluid sealing engagement with the conduit end cap 28. The pump 12 is characterized as a long slender cylindrical structure defined by the housing 42, the lower head member 30 and the upper head member 44. The housing 42 is dimensioned to be disposed in the driving fluid conduit 24 to leave a substantially annular space 160 between the housing 42 and the interior bore wall of the driving fluid conduit. The pump 12 is centered within the interior of the driving fluid conduit 24 by a frusto-conical shaped projecting end portion 31 of the head 30 which is adapted to engage a seat 162 formed as part of the bore 29 in end cap 28. An o-ring seal 164 is provided for sealing engagement between the end portion 31 and the seat 162. As shown in FIG. 6A, the head member 44 includes a body 45 with opposed externally threaded portions 166 and 168 and a frusto-conical seat 170 which is in communication with the passage 155 and with flow passages 172 opening into the chamber 54.

A coupling member 174 is retained connected to the pump 12 by a retaining collar 176 threadedly engaged with the portion 166 of the body 45 and retaining the coupling member 174 for limited axial sliding movement relative to the head member 44. The upper end 178 of coupling member 174 is threadedly connected to the lower end of the production fluid conduit 26 and is engageable with the retaining collar 176 at cooperating shoulders 180 and 182. The lower end of the coupling member 174 comprises a frusto-conical shape closure member 186 which is engageable with the seat 170 to form a fluid-tight seal including cooperating seal rings 188 and 189. The coupling member 174 includes an axial flow passage 175 which communicates the chamber 54 with the production fluid conduit 26 and, in response to axial upward lifting movement by the conduit 26, the coupling member 174 is adapted to move axially a limited distance to disengage from the seat 170 and allow fluid in the interior of the conduit 26 to flow out into the annular passage 160 through radially extending ports 177 formed in the sidewall of the retaining collar 176.

When the pump 12 is being inserted into the conduit 24 fluid may be displaced through the space 160 and/or through the passage formed by seat 162 into the wellbore 14 if the conduit 26 has a standing column of fluid therein. Once the pump 12 is lowered to engage the end portion 31 with the seat 162, the bottom end of the space 160 formed by the conduit 24 is sealed and the conduit may be filled with pump driving fluid such as water. Although fluid will not be standing in the wellbore 14 from the formation to the surface, in most cases, some fluid will always be present at a height greater than the working position of the pump 12. Accordingly, as the pump is lowered toward engagement with the end cap 28, the chambers 54, 56, 62, and 64 will fill with fluid present in the wellbore and in the interior of the conduit 24. After the priming action which occurs inherently with positioning the pump 12 in a wellbore having fluid present therein the conduit 24 is then filled with the pump driving fluid. The amount of well or production fluid present in the wellbore 14 and the interior of the conduit 24 and which enters the chamber 56 is typically negligible in proportion to the total amount of fluid added after seating of the pump 12 in the end cap 28. However, if the fluid level present in the wellbore extends substantially toward the surface 18 the pump 12 should be lifted from engagement with the end cap 28 and water or another selected driving fluid pumped down into the interior of the conduit 24 and into the wellbore so that substantially all of the driving fluid during operation of the pump comprises a selected fluid column instead of the fluids naturally present in the wellbore.

Prior to pulling the pump 12 out of conduit 24 for modification or repair, the conduit 26 would typically be full of fluid. However, as the pump is lifted upward out of its seated condition, as shown in FIGS. 6, 6A and 6C, the coupling member 174 will move upward relative to the retaining collar 176 to permit fluid to flow out of the conduit 26 through the passage 175 and the ports 177 into the interior of the conduit 24. This permits pulling the pump 12 and the production fluid conduit 26 in a so-called dry condition which is desirable during pump servicing and other operations requiring withdrawal of the conduit 26 from the well.

Referring further to FIGS. 6A, 6B and 6C the housing 42 is characterized by two elongated tubular members 190 and 192 which are both provided with suitable internally threaded portions on their opposite ends. The housing member 190 is threadedly connected to the lower threaded end portion 168 of the head member 44 and to an upper externally threaded portion 194 of the partition member 46. The partition member 46 includes an opposed externally threaded end portion 196 coupled to one end of the lower housing member 192. The opposite end of the housing member 192 is threadedly coupled to a cooperating threaded portion 197 of head member 30.

Figure 8:
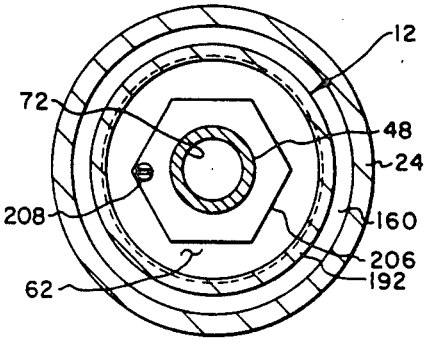
FIG. 8 is a transverse section view taken along the line 8—8 of FIG. 6B.

Referring to FIGS. 6B and 8, the partition member 46 includes an elongated central bore 200 which is threaded at its lower end and is formed with a transverse shoulder 202 at its upper end. The bore 200 forms a stuffing box for receiving suitable packing 204 which is retained in the bore by a packing nut 206. The nut 206 is suitably locked by a set screw 208 threadedly engaged therewith and with the lower end face of the partition 46. The packing 204 sealingly engages the tubular rod 48 of the piston assembly 47. O-ring seal members 210 are disposed in the partition 46 and in the packing nut 206 and also engage the rod 48 in sliding sealing engagement therewith. The production fluid flow passage 72 extends from the valve 70 to a chamber 214 formed in piston 50, FIG. 6B. A plurality of axially extending passages 216 open from the chamber 54 into the piston chamber 214. In like manner, the passae 72 may be in communication with a chamber 217 in piston 52, FIG. 6C, which is in communication with the chamber 62 through axially extending channels forming passages 218 formed in a separable, generally cylindrical piston member 227 forming a part of piston 52. The chamber 217 is also operable to be in communication with a passage 220 formed in the piston 52 and which opens into a further passage formed by an enlarged bore 222 for the check valve 67. The check valves 67, 70 and 33 are characterized as spherical ball type closure members and the valve 67 is engageable with a seat surface 224 formed between the passages 220 and 222. In like manner, the valve 70 is engageable with a seat surface 228 formed in the piston member 227 which is threadedly engaged with piston 52 at 233 and defines the passages 218. The piston rod 48 is secured to the piston member 227 by a nut 229 which is threadedly engaged with one end of the rod and with member 227 to provide for disassembly of the piston assembly 47 and access to the check valve closure members 67 and 70. Thanks to the arrangement of valves 67 and 70 a minimum amount of production fluid is retained in chamber 62 at the end of a production fluid delivery stroke. Accordingly, upon expansion of chamber 62 very little fluid is subject to release of entrained gas thereby avoiding a gas lock condition wherein fluid will not flow into chamber 62 from chamber 64 due to expansion of gas from fluid remaining in chamber 62. The valves 67 and 70 are also retained for limited movement by suitable retaining pins 230. The valve 33 is movable within an enlarged diameter passage 231 intersecting the passage 30 and forming a valve seat 232. A retaining pin 230 is also supported on the head member 30 for retaining the valve closure member within the passage 231.

The piston 52 includes an axially extending reduced diameter member 240 forming the passages 220 and 222 and operable to support a suitable chevron packing 244 for sealing engagement with the bore wall 193 of housing member 192. The piston member 240 in effect comprises a packing nut which is threadedly engaged with the piston 52 and has a head portion 246 engageable with a packing retaining washer 248. Fluid relief or lubricating passages 250 are formed in the piston 52 and open from chamber 217 to the bore wall 193 of the housing member 192.

Referring to FIG. 6B, the piston 50 is of similar construction and includes a removable head member 256 threadedly engaged therewith and defining the passages 216 and the cushion chamber 154. A separable packing nut 260 is threadedly engaged with the piston 50 and retains a chevron packing assembly 244 between a shoulder 251 and a washer 248. The nut 260 is provided with internal threads for threadedly coupling the piston 50 to the rod 48 and the nut 260 includes a passage 261 interconnecting chamber 214 with passage 72. A set screw 270 is threadedly engaged with the head 266 to assist in retaining the rod 48 in assembly with the nut 260.

The operation of the pump 12 is believed to be readily under standable from the foregoing description of the operation of the pumping system 10. However, briefly, when the piston assembly 47 is in the position illustrated in FIGS. 6A through 6C, the chamber 64 is at a minimum volume, chamber 62 is at maximum volume, chamber 56 is at minimum volume and chamber 54 is at maximum volume. As the piston assembly 47 moves upward in the housing 42 valve 67 closes and production fluid is displaced from chamber 62 through passages 218, 217, check valve 70 and through passage 72, chamber 214, passages 216 and into chamber 54. At the same time, of course, chamber 54 is being reduced in volume as fluid is discharged through passages 172 and 175 through the production fluid conduit 26. The chamber 56 is expanding in volume as driving fluid enters this chamber through the passages 74 in partition 46. The chamber 64 is expanding and drawing production fluid into the pump through passages 32 and 231 with check valve 33 in an open position. As the piston assembly 47 reaches the upper limit of its stroke it is cushioned by the projection 150 entering the cushion chamber 154 whereupon a substantially throttled flow of fluid through passage 155 is permitted to control the rate of deceleration of the piston assembly 47 as it moves toward the head member 44.

When the power transfer apparatus 40 has reached the limit of its stroke to displace driving fluid from chamber 100 and begins to displace fluid from chamber 98 the piston assembly 47 commences a downward stroke, viewing FIGS. 6A through 6C whereby check valve 33 will close to prevent flow of production fluid from chamber 64 through the passages 231 and 32. However, as chamber 64 is decreasing in volume chamber 62 is increasing in volume and fluid will transfer from chamber 64 to chamber 62 through passages 220, 222, 217 and 218. The substantial pressure from the standing column of production fluid in the production conduit 26 as well as the pressure buildup provided by the pressure relief valve 104 will cause check valve 70 to remain closed as fluid in conduit 26 returns to chamber 54 and urges the piston assembly 47 downwardly.

Figure 9:
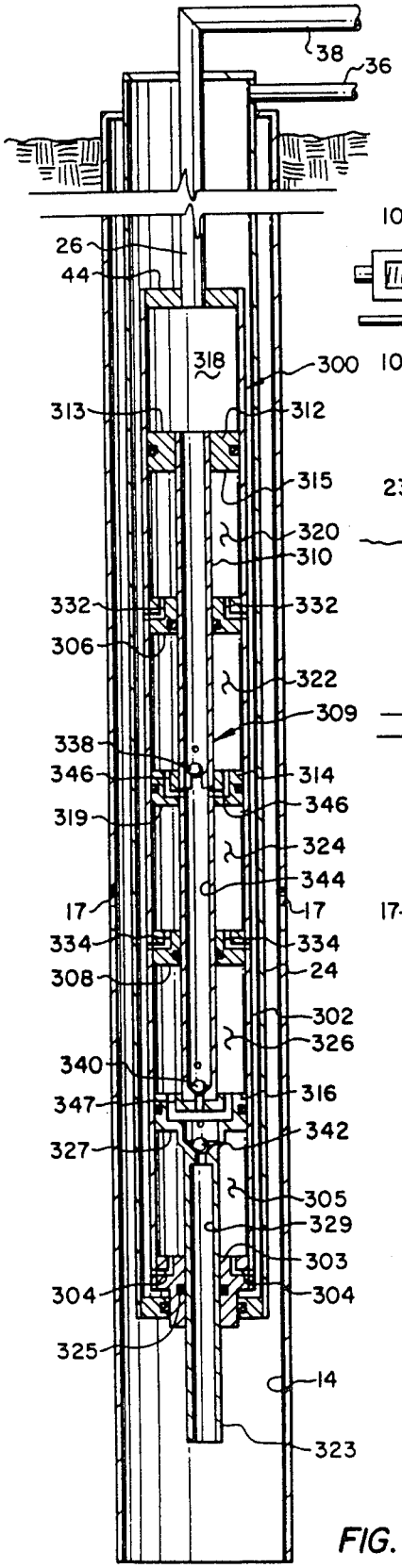
FIG. 9 is a schematic diagram of one alternate embodiment of the downhole pump.

Referring now to FIG. 9, an alternate embodiment of a pump in accordance with the present invention is illustrated and generally designated by the numeral 300. The pump 300 is adapted to be disposed in the driving fluid conduit 24 and includes a generally tubular housing 302 having a bottom head member 303 which is adapted to be seated in the end cap 28 of the driving fluid conduit. Passages 304 formed in the head member 303 open into a chamber 305 within the interior of housing 302 and are in communication with the interior of the conduit 24. The housing 302 also includes an upper head member 44 and two spaced apart partitions 306 and 308. An elongated piston assembly 309 is disposed in the tubular housing 302 and includes a tubular piston rod 310 extending through the partitions 306 and 308 in sliding and substantially fluid sealing relationship thereto.

The piston assembly 309 includes spaced apart pistons 312, 314 and 316 secured to the tubular rod 310 and dividing the housing 302 into respective fluid chambers 318, 320, 322, 324, 326 and 305. The chambers 320 and 324 are also operable to be in communication with the interior of the driving fluid conduit 24 through respective passages 332 formed in the partition 306 and passages 334 formed in the partition 308. The chambers 322 and 326 are operable to be in communication with the wellbore 14 through a fluid draft tube 323 extending downward from piston 316 through a bore in head member 303 in slidable sealed relationship thereto. Suitable seal means 325 is provided in the head member 303 as shown. Check valves 338, 340 and 342 are interposed in passage means in the piston assembly 309 and draft tube 323 including an elongated passage 344 formed in the piston rod 310 and a passage 329 in tube 323.

In response to a downstroke of the piston assembly 309 fluid is transferred from the wellbore 14 to chambers 326 and 322 as the check valves 338 and 340 are unseated to allow fluid to flow into the respective chambers. Suitable passages 346 are formed in the piston 324 and are in communication with the passage 344 for conducting production fluid into and out of chamber 322 and passage means 347 communicates the chamber 326 with the draft tube 323 and the passage 344 by way of check valves 342 and 340, respectively. Check valve 338 remains closed under the urging of production fluid flowing from conduit 26 back into chamber 318 and passage 344 above the check valve 338. Both conduits 26 and 24 are suitably connected to the power transfer apparatus 40 (not shown in FIG. 9) in the same manner as the pump 12. Accordingly, during a downstroke of the piston assembly 309 production fluid flowing back into chamber 318 acts on the upper transverse face 313 of piston 312 but is blocked from flowing into chambers 322 or 326 by the check valve 338. Accordingly, the chambers 322 and 326 are being filled with a fresh charge of production fluid during downstroke movement of the piston assembly 309.

When the piston assembly 309 reaches the lower limit of its downstroke driving fluid acting on the bottom faces 315, 319, and 327 of respective pistons 312, 314 and 316 urges the piston assembly 309 in the opposite direction, check valve 342 closes but check valves 338 and 340 are unseated to allow production fluid to flow from chambers 326 and 322 through respective passages 347 and 346 into and upward through passage 344 and through chamber 318 into the production fluid conduit 26. Since the total effective piston area of the piston assembly 309 exposed to driving fluid acting on the lower faces of pistons 312, 314 and 316 exceeds the pressure force acting on the upper face 313 of piston 312 due to the fluid column in the conduit 26, the piston assembly 309 is normally biased in its upward limit position by the standing column of fluid in the conduit 24. The general operation of the pump 300 is substantially like that of the pump 12 and a further detailed description of the operation of the pump 300 in conjunction with the power transfer apparatus 40 is not believed to be necessary to an understanding of the invention.

The pump 300 is typically used in wells with production fluid of high liquid content or very low entrained gases. The pump 300 is also adapted to operate at very low pressures in the wellbore 14 due to the presence of a relatively short standing column of production fluid in the wellbore since the only pressure requirement to operate the pump is that required to unseat the check valves 340 and 342 during pump downstroke.

Figure 10:
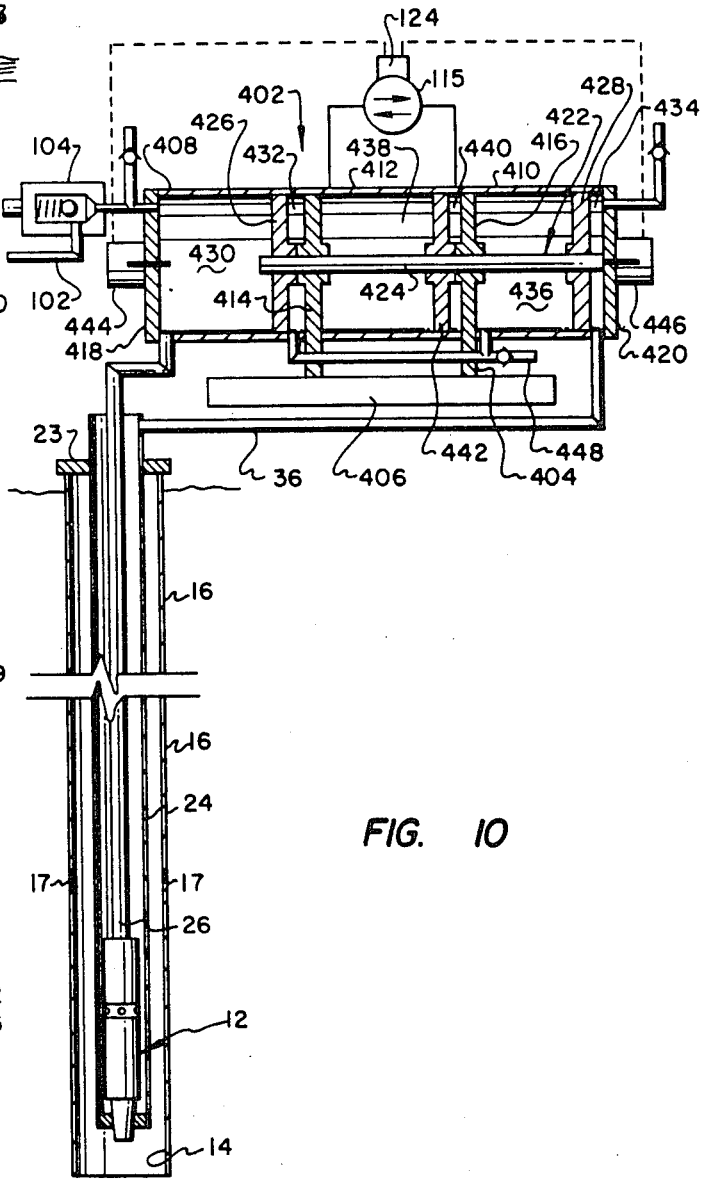
FIG. 10 is a schematic diagram of one alternate embodiment of a power transfer apparatus for the well pump system.

Referring now to FIG. 10 another embodiment of a hydraulically operated pump system in accordance with the present invention is illustrated and generally designated by the numeral 400. The pump system 400 includes a downhole pump 12 disposed in well bore 14 within the driving fluid conduit 24 and is connected to the lower end of production fluid conduit 26. The pump system 400 includes a modified power transfer apparatus, generally designated by the numeral 402 which comprises a frame 404 mounted on a suitable base structure 406 and adapted to form horizontally opposed cylinders 408 and 410 between which an intermediate cylinder 412 is also formed. The cylinder 412 includes opposed head members 414 and 416 which also delimit adjacent ends of the cylinders 408 and 410. The cylinder 408 includes an outer head member 418 and the cylinder 410 includes an outer head member 420. The power transfer apparatus 402 includes a reciprocating piston assembly, generally designated by the numeral 422, and comprising a piston rod 424 reciprocably supported by the frame 404 and extending through the head members 414 and 416. The piston rod 424 is secured to pistons 426 and 428 disposed in the respective cylinders 408 and 410. The piston 426 divides the cylinder 408 into opposed fluid chambers 430 and 432 and the piston 428 divides the cylinder 410 into opposed chambers 434 and 436. The chamber 430 is in communication with the production fluid conduit 26 for receiving production fluid from the pump 12 and the chamber 434 is in communication with the driving fluid conduit 24 for oscillating a column of driving fluid between the cylinder 410 and the pump 12.

The power transfer apparatus 402 also includes the reversible pump 115 which is operably connected to opposed chambers 438 and 440 formed in the cylinder 412 by a driving piston 442 secured to the rod 424. The pump 115 is provided with a controller 124 which is adapted to receive signals for reversing the direction of flow of fluid from the pump in response to actuation of position sensors 444 and 446 disposed on the respective head members 418 and 420 and adapted to sense the position of the piston assembly 422 as the assembly approaches the respective head members.

The power transfer apparatus 402 is also characterized by the provision of pressurized inert fluid through a conduit 448 from a suitable source, not shown, to be introduced into the chambers 432 and 436, respectively. The chambers 432 and 436 may be suitably pressurized with an inert fluid such as nitrogen to prevent any leakage flow of production fluid from the chamber 430 into the chamber 432 or leakage flow of driving fluid from the chamber 434 into the chamber 436. Since the chambers 432 and 436 are in communication with each other through conduit 448, the inert fluid charge in one chamber is merely transferred to the other chamber during reciprocation of the piston assembly 422, resulting in virtually no work consumption.

The power transfer apparatus 402 is operable to reciprocate the piston assembly 47 of pump 12 in the same manner as the power transfer apparatus 40. However, in response to reciprocation of the piston assembly 422 under the urging of hydraulic fluid oscillated between the chambers 438 and 440 by the pump 115, during a stroke of the piston assembly 422 to the right, viewing FIG. 10, driving fluid is displaced from the chamber 434 into the conduit 24 and production fluid is displaced from the pump 12 through the conduit 26 into the chamber 430 and through minimum pressure valve 104 to the production fluid delivery conduit 102. As the piston assembly 422 reaches a predetermined stroke limit on approaching the cylinder head 420, the sensor 446 will cause controller 124 to reverse the direction of flow of fluid through the pump 115 to drive the piston assembly 422 in the opposite direction, that is to the left, viewing FIG. 10, whereupon production fluid will be displaced from the chamber 430 into the conduit 26 to move the pump 12 through a delivery chamber filling stroke as previously described. During movement of the piston assembly 422 to the left, viewing FIG. 10, driving fluid is displaced from the pump 12 and into the cylinder chamber 434. Of course, as the piston assembly 422 approaches the cylinder head 418, the sensor 442 is operable to effect operation of the pump controller 124 to again reverse the direction of fluid flow from the pump 115 to reverse the direction of movement of the piston assembly. The inert fluid, such as gaseous nitrogen, in the chambers 432 and 436 oscillates between these chambers and is maintained at a predetermined pressure to prevent leakage flow of production and/or driving fluid into the respective chambers 432 and 436. Accordingly, the power transfer apparatus 402 provides a unique pump driving device which is relatively compact. Those skilled in the art will appreciate that the power transfer apparatus 40 and 402 may also be utilized to pump fluids for other uses.

Figure 11:
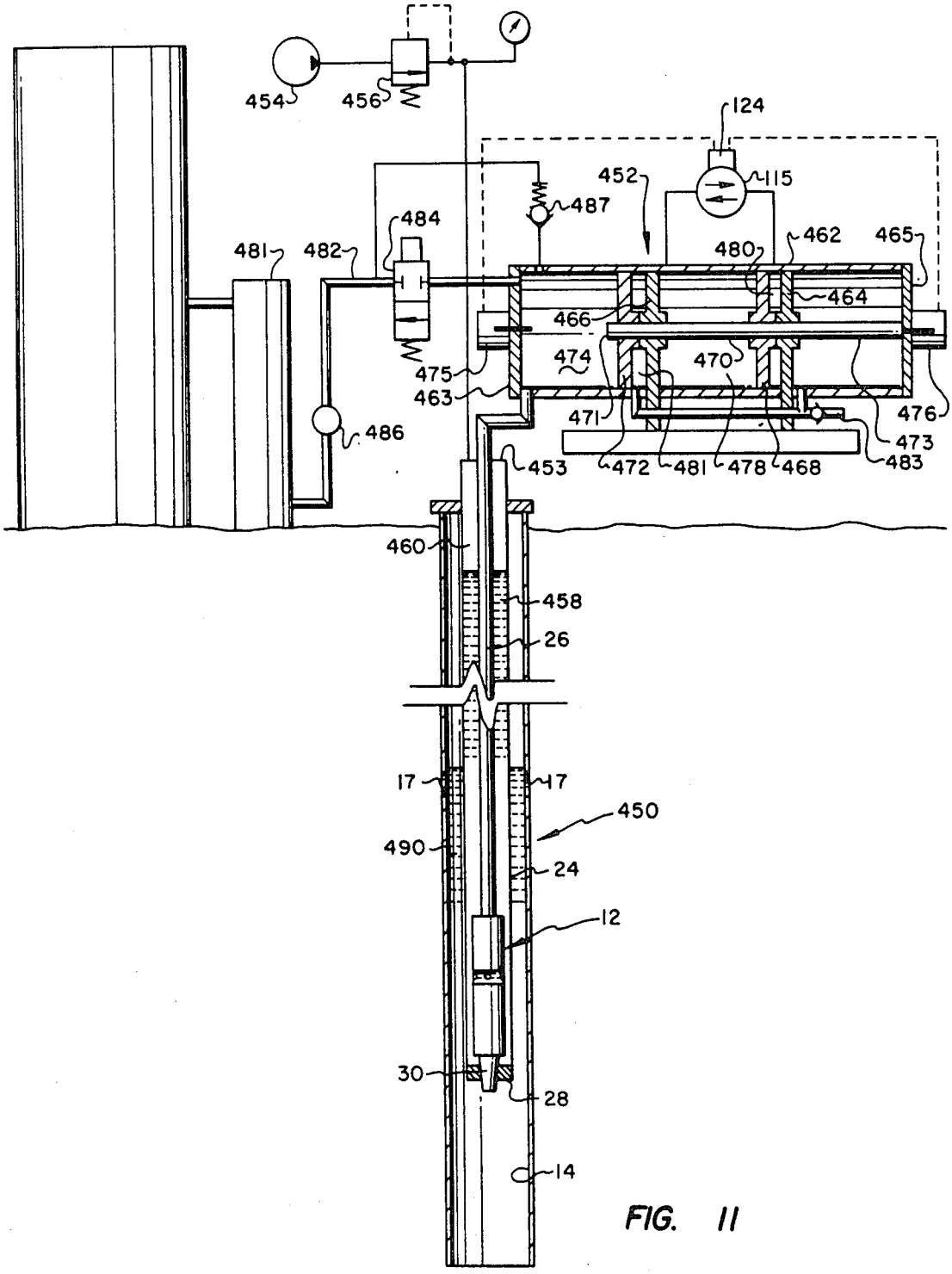
FIG. 11 is a schematic diagram of one alternate embodiment of the well pump system.

Referring now to FIG. 11 there is illustrated yet another embodiment of a hydraulic well pumping system, generally designated by the numeral 450. The pump system 450 includes a downhole pump 12 disposed in a driving fluid conduit 24 and seated in sealed engagement with the end cap 28. The pump 12 is also connected at its upper end to a production fluid conduit 26 which is in communication with a power transfer apparatus 452. The conduit 24 is closed at its top end 453 and is in communication with a source of pressure gas such as nitrogen by way of a pump 454 and a pressure regulator 456. The conduit 24 is substantially filled with a driving fluid 458, such as water, to a predetermined level and a gas chamber 460, formed at the top of the driving fluid conduit 24, is charged with pressure gas from the pump source 454 at a predetermined pressure as determined by the regulator 456. Accordingly, a substantially constant bias force is acting on the piston assembly 47 of the pump 12 urging it in an upward direction to displace production fluid through the conduit 26 to the power transfer apparatus 452.

The power transfer apparatus 452 includes a cylinder 462 having internal partitions 464 and 466, opposed end heads 463 and 465 and a hydraulic driving piston 468 disposed in the cylinder between the partitions 464 and 466. The piston 468 is connected to a rod 470 which extends through the partition 466 and is secured to a piston 472 forming a production fluid displacement chamber 474 in cylinder 462 between the piston and the head 463. The piston rod 470 includes opposed end portions 471 and 473 which are engageable with position sensors 475 and 476, respectively. The position sensors 475 and 476 are operable to control the reversible hydraulic pump 115 by way of its controller 124 to deliver hydraulic fluid alternately to opposed cylinder chambers 478 and 480 formed on opposite sides of the piston 468. The production fluid chamber 474 is in communication with a delivery tank 481 by way of a delivery conduit 482 and a power operated valve 484. The valve 484 may be characterized as a normally open valve which is solenoid operated, for example, to be in a closed position. The valve 484 is adapted to be interposed in a control circuit including the position sensors 475 and 476 whereby the valve will be opened during a phase of the operating cycle of the power transfer apparatus 452 wherein the pistons 468 and 472 are moving to the right, viewing FIG. 11, to increase the volume of chamber 474. During this phase of operation of the pump system 450, the pressure exerted on the pump 12 by the column of driving fluid 458 and the pressure of gas in the chamber 460 will stroke the pump 12 through a delivery stroke cycle to fill the chamber 474 and to cause fluid to flow through the delivery line 482 to the tank 481. When the piston rod 470 engages the position sensor 476 the valve 484 may be actuated to a closed position so that as the pistons 468 and 472 move toward the left, viewing FIG. 11, to displace fluid from the chamber 474 production fluid is returned through the conduit 26 to the pump 12 to cause the pump to move through a production fluid intake stroke to fill the chamber 62. When the piston rod end 471 engages the position sensor 475, the valve 484 may be actuated to the open position preparatory to another fluid delivery cycle. Since the movement of the pump piston assembly 47 through a production fluid delivery stroke is independent of the movement of the pistons 468 and 472 to increase the volume of the chamber 474, it may be desirable to control the actuation of the valve 484 utilizing a flow sensing switch 486 which, upon sensing a predetermined quantity of fluid flow, or a change in fluid flow through conduit 482 indicating a completion of a delivery cycle of the pump 12, will actuate the valve 484 to move to a closed position. A pressure relief valve 487 bypasses the valve 484 to prevent damage to the pump 12 in the event that the timing of the closure of the valve 484 should fail to coincide with the completion of a delivery stroke of the pump 12.

One advantage of the pumping system 450 is that the amount of production fluid 490 standing in the wellbore 14 together with the pressure in the chamber 460 and the height of the column of driving fluid 458 may be correlated to provide for a production fluid delivery stroke of the pump 12. Accordingly, the pressure in the chamber 460 may be set such that a pump delivery stroke will occur only when a sufficient column height of fluid 490 in the wellbore 14 is present to provide the additional pressure force acting on the piston surface 53 to move the piston assembly 47 through a delivery stroke. In this way the pump system 450 may be operated to prevent overpumping a well and possibly damaging the subterranean formation characteristics. An advantage of the pumping system 450 is that the height of the column of driving fluid 458 may be selectively adjusted as may the pressure in the accumulator chamber 460 in accordance with the pump working pressure requirements.

Figure 12:
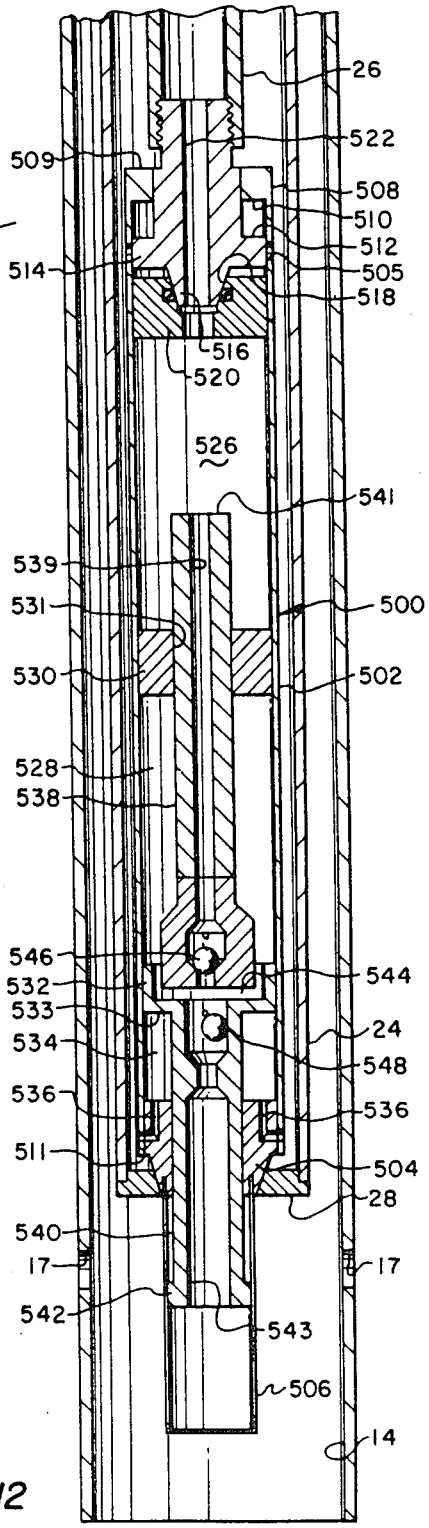
FIG. 12 is a somewhat schematic diagram of a second alternate embodiment of a downhole pump.

Referring now to FIG. 12 another embodiment of a downhole pump in accordance with the present invention is illustrated in somewhat schematic form and generally designated by the numeral 500. The pump 500 is shown disposed in the driving fluid conduit 24 within wellbore 14 and comprises an elongated tubular housing 502 having a lower head member 504 of a configuration similar to the head member 303 and adapted to be seated in sealing engagement with the end cap 28. The head member 504 supports an elongated foraminous tubular sand screen member 506 extending downward from the head member 504 into the wellbore 14. The opposite end of the housing 502 includes a head portion 508 having a transverse shoulder 510. The shoulder 510 is engageable with a cooperating shoulder 512 formed on a coupling member 514 having a depending tapered portion 516 adapted to be seated in a tapered bore 518 formed in a housing partition 520. An elongated passage 522 extends through the coupling member 514 and is in communication with the interior of the production fluid conduit 26. The coupling member 514 is suitably threadedly connected to the conduit 26 as indicated in FIG. 12.

The housing 502 is divided into opposed production fluid transfer and delivery chambers 526 and 528 by an interior fixed partition 530. The delivery chamber 528 is further defined by a piston 532 slidably disposed in the interior bore of the housing 502. An expansible driving fluid chamber 534 is formed in the housing 502 between the piston 532 and head member 504. Driving fluid is communicated to the chamber 534 through passages 536 formed in the head member 504 and opening into the interior of the conduit 24. A tubular rod 538 extends upward from the piston 532 and through a close fitting bore 531 in the partition 530 and into the chamber 526. The piston 532 includes a depending tubular rod portion 540 having a removable screen scraping piston head 542 formed on the lower distal end thereof. A passage 543 in the rod 540 opens into the chamber 528 through a passage 544 interposed between check valves 546 and 548. The arrangement of the check valves 546 and 548 is substantially like that of the check valves 70 and 67, respectively, in the piston 52 of pump 12 whereby a minimum volume of fluid remains in the chamber 528 after displacement of fluid therefrom through a passage 539 formed in the rod 538.

The pump 500 is particularly adapted for use in low volume production wells. Driving fluid in the conduit 24 enters the chamber 534 through the passages 536 and acts on piston face 533 to urge the piston 532 on an upward production fluid delivery stroke wherein fluid is displace from the chamber 528 through passage 544, unseating check valve 546 and delivering fluid through passage 539 and chamber 526 into the production fluid conduit 26. The pump 500 is adapted to be used with the power transfer apparatus described in conjunction with pump systems illustrated in FIGS. 1, 10 or 11. Accordingly, in response to returning production fluid through the conduit 26 into the chamber 526 a pressure force acting on the rod end face 541 will urge the piston 532 downward maintaining the check valve 546 closed and allowing the check valve 548 to open to admit production fluid from the wellbore through passages 543 and 544 into the chamber 528. During reciprocation of the piston 532 a pumping action created by the rod 540 and the scraper head 542 maintains the sand screen 506 free of debris and said accumulation thereon.

The arrangement of the coupling member 514 is similar to that of the pump 12 whereby, upon lifting the pump 500 with the production conduit 26, the coupling member 514 will move out of sealing engagement with the bore 518 into engagement with the shoulder 512 to allow fluid to flow through ports 505 formed in the housing 502 so that the pump 500 may be pulled from the conduit 24 in a "dry" condition. As with the pump 12 the area of an upward facing transverse end face 509 is designed to be greater than the opposing face area of the lower transverse end face 511 formed on the head 504 and exposed to the pressure fluid in the conduit 24. In this way the standing column of pump driving fluid acts with a resultant force on the pump 500 to maintain the pump seated in engagement with the end cap 28 during operation of the pump. The hold down force exerted on the pump 500 if used in conjunction with the system of FIG. 11 may be accentuated by the amount of fluid pressure in the accumulator chamber 460. Accordingly, a pump such as the pumps 12, 300 or 500, if used in an accumulator type system for the driving fluid, may be unseated somewhat easier than the other pump system configurations since the portion of the holddown force controlled by pressure gas in the chamber 460 may be reduced before unseating the pump from the conduit end cap 28.

Figure 13:
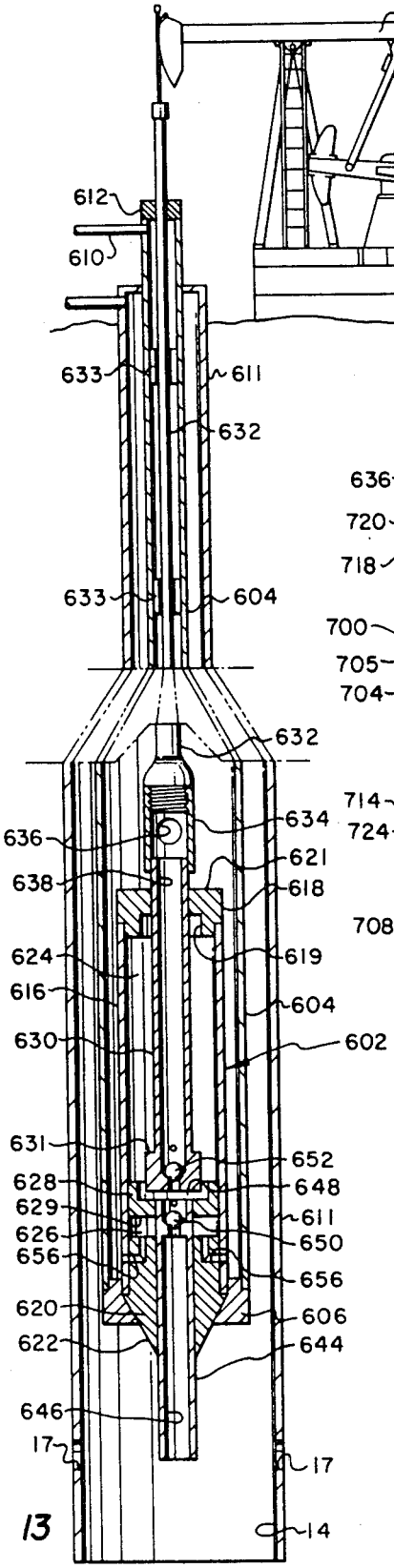
FIG. 13 is a schematic diagram of a second alternate embodiment of the well pump system.

Referring now to FIG. 13 another pumping system in accordance with the present invention is illustrated and generally designated by the numeral 600. The scale of drawing FIG. 13 is modifed to show details of the downhole pump as well as the wellhead apparatus. The pump system 600 is a modified mechanically actuated and hydraulically actuated system and employs a downhole pump 602 disposed in a production fluid conduit 604 having an end cap 606 at the lower end thereof and constructed similar to the end cap 28 of the driving fluid conduit 24 for the pumping system embodiments previously discussed. The conduit 604 extends to a wellhead 608 and is in communication with a production fluid delivery line 610. A conventional polish rod stuffing box 612 is mounted at the upper end of the conduit 604.

The wellbore 14 may be cased by a suitable casing 611 which extends to the wellhead 608 in a conventional manner.

The pump 602 includes an elongated cylindrical tubular housing 616 having an upper head portion 618 and a lower head portion 620 which is provided with a conically tapered portion 622 adapted to be seated in sealing engagement with the end cap 606 in a manner similar to the construction of the pump 12, for example. The pump housing 616 is divided into upper and lower chambers 624 and 626 by a piston assembly 628 having an upwardly extending tubular rod portion 630 which extends through the head member 618 and is coupled to an elongated pump rod 632, commonly known as a sucker rod, by a tubular coupling member 634. The coupling member 634 is provided with a passage 636 which opens into the interior of the conduit 604 from a passage 648 formed in the piston rod 630. The pump rod 632 is of conventional construction and extends upward through the stuffing box 612 and is connected to a walking beam 640 of a conventional well pumping mechanism 642.

The piston 628 also includes a downwardly extending tubular rod portion 644 providing a passage 646 which is in communication with a passage 648 in the piston by way of a check valve 650. A second check valve 652 provides for one way flow between passages 648 and 638. The construction of the piston 628, in regard to the arrangement of the check valves 650, 652 and the passage 648, is similar to the corresponding structure of the pumps 12 and 500, for example.

Fluid in the interior of conduit 604 is admitted to the pump chamber 626 by way of passages 656 formed in the head 620. In the position of the piston 628 illustrated in FIG. 13 it will be assumed that the chamber 624 has been filled with production fluid from the wellbore 14 by way of passages 646 and 648 during unseating of the check valve 650 which would occur during a downstroke of the piston 628 from a minimum volume condition of the chamber 624 to the position of the pump illustrated in the drawing figure. When the pump actuation mechanism 642 exerts an upward pulling force on the rod 632, the piston 628 is lifted by the rod 630 to displace fluid from chamber 624 through passage 648 unseating check valve 652 to cause fluid to flow through passage 638 and passage 636 into the interior of the conduit 604. The net force required to displace a quantity of production fluid from the chamber 624 is assisted by the pressure head of the column of fluid standing in the conduit 604 which is exerted on piston face 629 to assist in displacing fluid from the chamber 624 into the conduit 604.

When the pumping unit 642 actuates the rod string 632 to move the piston 628 from the lowermost position shown in FIG. 13 upwardly, fluid is displaced from chamber 624, however, production fluid is also flowing into chamber 626 which has a volume equal to chamber 624. Accordingly, during a pump upstroke there is no net delivery of fluid to and through the delivery conduit 610. However, the fluid acting on the piston face 629 assists in lifting the rod string 632. When the piston 628 has reached the upper limit of its upstroke a shoulder 631 is operable to enter a dash pot chamber 619 formed in the head member 618 to cushion the upper stroke limit position of the piston assembly. Accordingly, the pumping unit 642 is required to lift only the weight of the rod string 632 and overcome frictional resistance of the fluid column and mechanical friction in the pump 602 during an upstroke.

During downstroke of the rod string 632 some contrction of the rod string will occur as a result of the reduction in tensile stress and subsequently some compression of the rod string will occur as downstroke commences. However, the weight of the rod string will operate to displace production fluid out of the chamber 626 into the interior of the conduit 604. The check valve 652 will be maintained in a closed position under the urging of the pressure of fluid in the interior of the conduit 604 and the passage 638, and the check valve 650 will open to admit a fresh charge of production fluid from the wellbore 14 into the chamber 624. Conventional sucker rod bumpers or centralizers 633 may be interposed along the rod string 632 to alleviate the tendency of the rod string to buckle under column loading.

The pump system 600 is particularly advantageous for relatively deep wells wherein the weight of the rod string 632, for example, becomes a limiting factor in the ability to operate a downhole pump. By splitting the work required of the pumping unit 642 to occur on both the upstroke and downstroke many of the detrimental effects of rod actuated pumps, particularly for operating in deep wells, may be overcome by the pump system 600. The downhole pump 602 may share several common parts with the other pump embodiments described herein including the arrangement of the check valves 650 and 652 in the piston 628, the lower head member 620 and the lower rod or draft tube 644. The draft tube 644 and the piston rod 630 are preferably of the same outer diameter. The pump 602 is maintained in seating engagement with the end cap 606 by the pressure force of production fluid in the conduit 604 exerted on the upper transverse end face 621.

Figure 14:
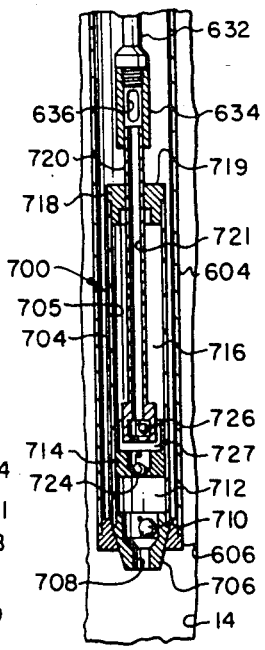
FIG. 14 is a somewhat schematic illustration of an alternate embodiment of a rod actuated pump for the system of FIG. 13.

A modified version of the rod actuated pump is illustrated in FIG. 14 and generally designated by the numeral 700. The pump 700 is adapted to be seated in the conduit 604 in the same manner as the pump 602 and comprises a cylindrical housing 704 having a lower head member 706 which is adapted to be seated in sealed engagement with the end cap 606 of the conduit 604. The head member 706 includes a fluid inlet passage 708 in which is interposed a check valve 710 for admitting fluid into an interior chamber 712 formed by the housing 704 and a reciprocable piston 714 interposed in the housing bore 705. A second chamber 716 is formed between the piston 714 and an upper head member 718 which is virtually identical to the head member 618 of the pump 602.

The piston 714 is connected to a tubular piston rod 720 which is adapted at its upper end to be coupled to the coupling member 634 and the rod string 632. The piston 714 is adapted to have the anti-gas lock check valve arrangement comprising check valves 724 and 726 interposed therein for admitting fluid from the chamber 712 to the chamber 716 during a downstroke of the piston and providing for displacement of fluid from the chamber 716 up through the passage 721 in the rod 720 and into the interior of the conduit 604 through the coupling 634.

During an upstroke of the piston 714 fluid is drawn from the wellbore 14 into the chamber 712 through the check valve 710 and, assuming that the chamber 716 is full of fluid, the check valve 726 is unseated to displace fluid from the chamber 716 into the interior of the conduit 604 through the aforementioned passages 721 and the passage 636 in the coupling 634. During a piston upstroke the check valve 724 is maintained closed. At the top of the upstroke of piston 714 the check valve 726 closes and, thanks to the minimum volume of the passages 727 between the valves 724 and 726 an insignificant amount of production fluid is trapped in chamber 716 and subject to expansion of entrained gases. As a piston downstroke commences the check valves 710 and 726 and check valve 724 opens to transfer fluid from the chamber 712 to the chamber 716. The pump 700 is biased in its seated position in engagement with end cap 606 by the pressure of fluid in conduit 604 acting on the transverse end face 719 of head member 718.

Figure 15:
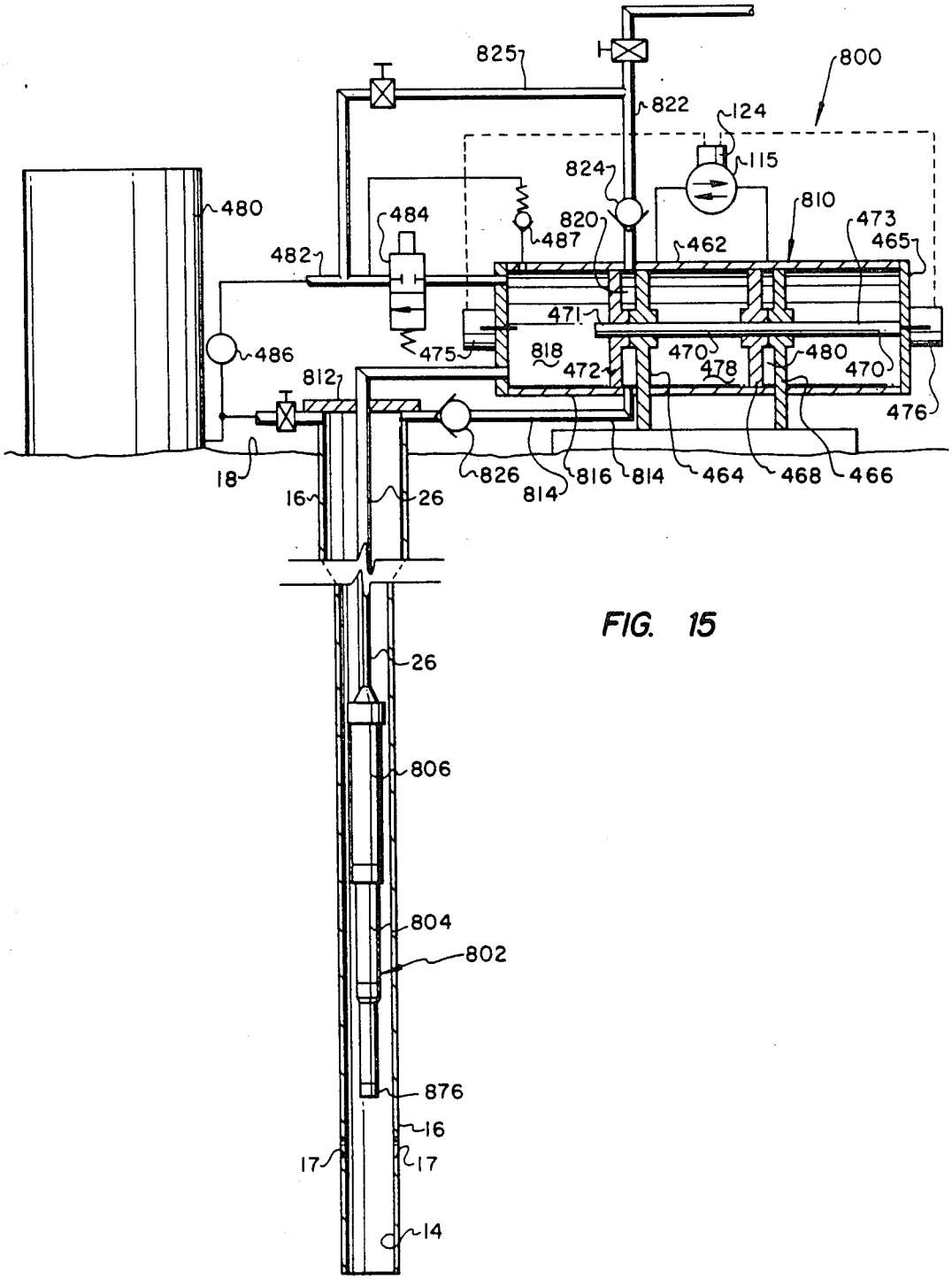
FIG. 15 is a schematic diagram of a third alternate embodiment of a well pump system in accordance with the invention.

Referring now to FIG. 15 another embodiment of a well pumping system in accordance with the invention is illustrated and generally designated by the numeral 800. The pumping system 800 is adapted to be operated in conjunction with the wellbore 14 also having the casing 16 and suitable perforations 17 for admitting production fluid into the wellbore from the producing formation. The pump system 800 includes a downhole pump, generally designated by the numeral 802 which is adapted to be disposed in the wellbore 14 at a point above the bottom to minimize the ingestion of sand or other debris into the pump inlet. The pump 802 includes an elongated tubular cylinder member 804 which is connected to a cylinder 806 comprising a gas charged accumulator structure which will be described in further detail herein. The upper end of the cylinder 806 is suitably connected to the production fluid delivery conduit 26 which extends to the surface 18 and is connected to a power transfer unit 810. In the arrangement of the pumping system 800 the casing 16 extends to the surface 18, is closed by a head portion 812 and is also in communication with a gas delivery conduit 814 leading to the power transfer unit 810.

As will be appreciated further herein, upon reading the detailed description of the pump 802, the pumping system 800 does not require a driving fluid conduit within the wellbore itself but effectively reciprocates the pump 802 by oscillation of production fluid in the conduit 26 in essentially the same manner as the pumping system illustrated in FIG. 11. In fact, the power transfer unit 810 is similar in many respects to the power transfer unit 452 and is characterized by a cylindrical housing 462 having internal partitions 464 and 466 and a hydraulically operated driving piston 468 reciprocably disposed in the cylinder 462 to form the chambers 478 and 480. A piston rod 470 extends through the spaced partitions 464 and 466 and is connected to a piston 472 disposed in a modified cylinder member 816. The cylinder 816 is divided into opposed chambers 818 and 820 which are, respectively, in communication with the conduit 26 and the gas delivery conduit 814.

The chamber 820 is also in communication with a gas discharge conduit 822 and one way compressor type check valves 824 and 826 are interposed in the conduits 822 and 814, respectively, to provide for delivery of gas from the wellbore 14 into and through the power transfer cylinder chamber 820 in response to reciprocation of the pistons 468 and 472. The power transfer unit 810 also includes the position sensors 475 and 476 which are operable to reverse the delivery of hydraulic fluid from the pump 115 to effect reciprocation of the pistons 468 and 472 by way of their interconnecting piston rod 470. The pumping system 800 also includes a solenoid operated valve 484 disposed in a production fluid delivery line 482 for delivery of well fluid to a storage tank 481 by way of a flow sensing switch 486. A gas bypass line 825 is interconnected between the delivery conduit 822 and the well fluid delivery conduit 482 to selectively discharge gas to the tank 481 with the liquid well fluid. Accordingly, the power transfer unit 810 is not only operable to effect oscillation of a portion of the production fluid delivered to the chamber 818 through conduit 26 to effect driving of the pump 802 but also provides for evacuating or reducing the pressure in the wellbore 14 to enhance production of well fluid and draw off any gas produced in the well. Operation of the power transfer unit 810 thereby effectively scavenges the wellbore 14 to a selected reduced pressure and compresses gas delivered to the chamber 820 for delivery to a suitable end use. The operation of the power transfer unit 810 being similar to the power transfer unit 452 is not believed to require any further detailed explanation.

Figure 16A:
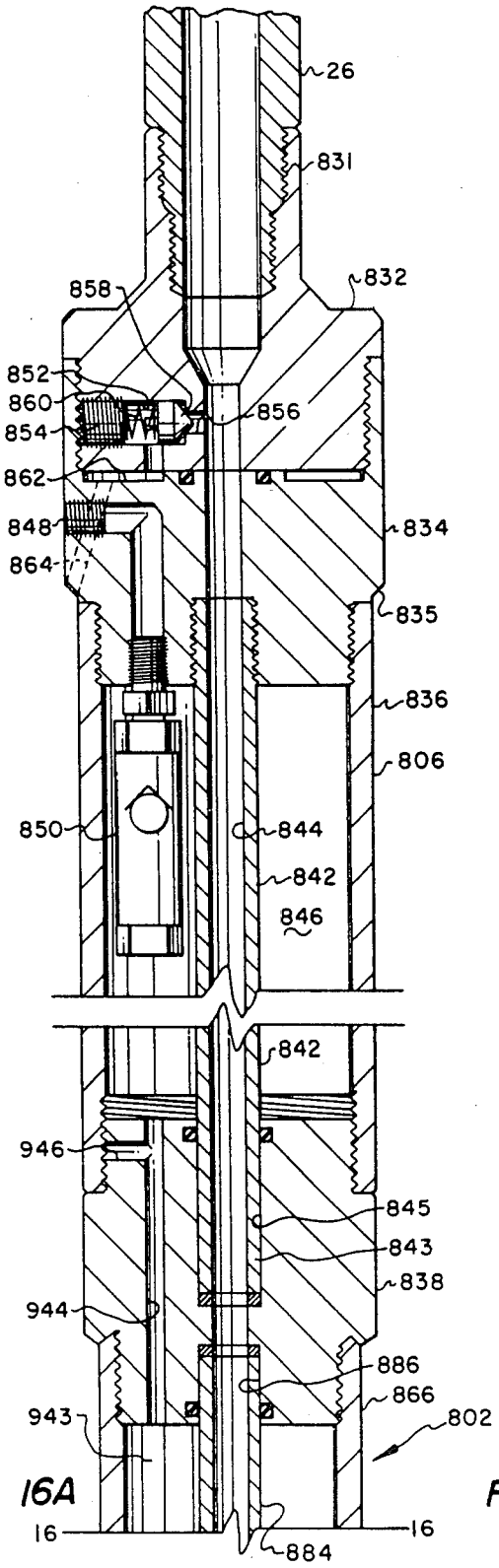
FIG. 16A is a longitudinal central section view of a portion of a third alternate embodiment of a downhole pump for use with the system of FIG. 15.
Figure 16B:
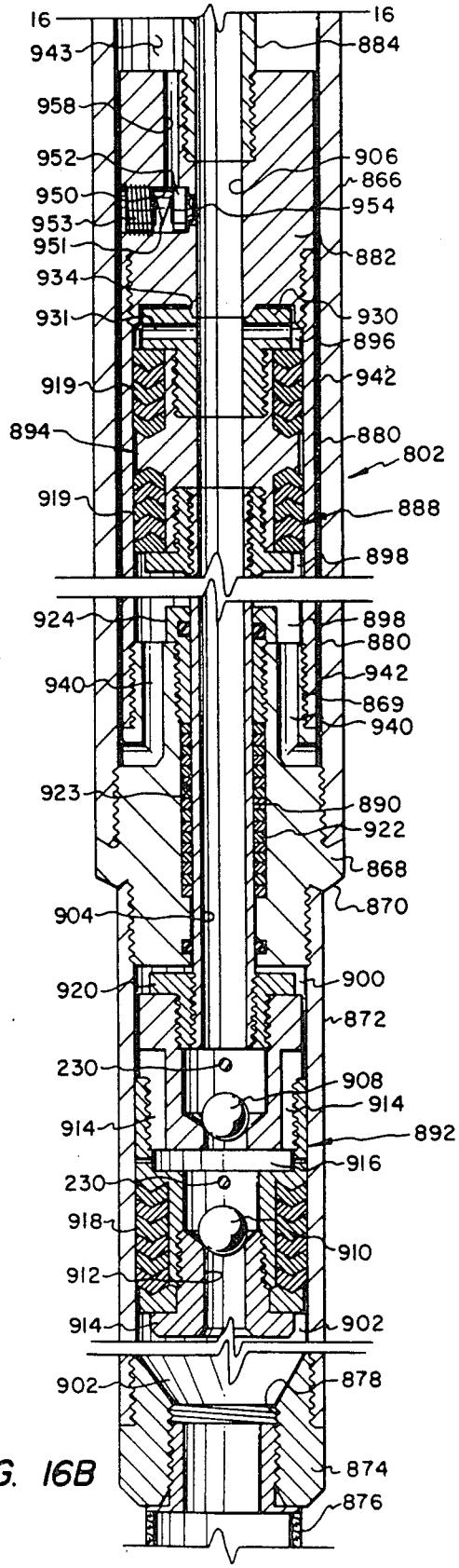
FIG. 16B is a continuation of FIG. 16A from the line 16—16.

A primary difference between the pump system 800 and the pump system 450 resides in the provision of a gas charged accumulator within the cylinder 806 instead of within the driving fluid conduit 24, which conduit has in fact been eliminated in the system illustrated in FIG. 15. Referring now to FIGS. 16A and 16B, the downhole pump 802 is illustrated in longitudinal central section view. Referring to FIG. 16A, in particular, the lower end of the production fluid delivery conduit 26 has a modified externally threaded portion 831 which is threadedly connected to a head member 832 of the cylinder 806. An intermediate head portion 834 is threadedly connected to the head 832 and to an elongated cylindrical tube 836. The lower end of the tube 836 is threadedly coupled to an intermediate connector member 838 forming the lower head of the cylinder 806. An elongated central conduit section 842 extends through the cylinder 806 and provides part of a passage 844 for conducting production fluid from the pump cylinder 804 to the production fluid conduit 26. The cylinder 806 may be disconnected from the pump cylinder 804, including the connector member 838, for handling the pump when inserting or withdrawing the pump with respect to the wellbore 14. In this regard, the conduit 842 includes a lower end portion 843 extending into a bore 845 formed in the connector member 838.

Referring further to FIG. 16A, in particular, the cylinder 806, together with the conduit 842, forms an annular chamber 846 between the head member 834 and the connector 838. The chamber 846 is adapted to be charged with pressure gas such as nitrogen through a charging port 848 which is in communication with a check valve 850 to provide for charging the chamber 846 with pressure gas before insertion of the pump 802 into a wellbore. The head member 832 is also provided with a transverse bore 852 closed by a plug 854 and opening into the passage 844 through a port 856. A spring biased pressure relief valve closure member 858 is disposed in the bore 852 and is biased to close the port 856 by a spring 860. The bore 852 is in communication with a fluid discharge passage 862, 864 leading to the exterior of the pump 802 for discharging fluid from the production delivery fluid conduit when it is desired to pull the conduit 26 from the wellbore in a "dry" condition. This may be accomplished by pressurizing the conduit 26 with an inert gas to drive well fluids out of the interior of the conduit through the valve 858. The head member 834 is of slightly larger diameter than the tube 836 to provide a transverse shoulder 835 which may be utilized to support the accumulator cylinder 806 during operations to insert and/or withdrawal the pump with respect to a wellbore.

Referring now primarily to FIG. 16B, the pump cylinder 804 comprises an elongated outer tubular member 866 which is threadedly connected to the member 838 at its upper end and is also threadedly connected to a partition member 868 at its lower end. The partition member 868 is also formed with a transvers ehoulder 870 for supporting the pump 802 in slips or other suitable means during preparation for insertion of the pump 802 with respect to a wellbore. The lower end of the partition member 868 is threadedly connected to a reduced diameter tubular housing member 872 which extends to and is threadedly coupled to a lower end cap 874. The end cap 874 may be suitably connected to a well fluid inlet filter screen structure 876 for filtering sand and other debris out of well fluids entering the interior of the pump 802 through an inlet passage 878.

Referring further to FIG. 16B, the cylinder 804 includes an inner housing structure comprising an elongated cylinder member 880 which is connected at its lower end to a reduced diameter boss portion 869 of the partition 868 and is connected at its upper end to a head part 882. The head part 882 is connected to a tubular conduit 884 which is insertable at its upper end into a bore 886 in the connector member 838. The pump 802 is similar in some respects to the pump 12 illustrated in FIGS. 6A, 6B and 6C in that an elongated piston assembly 888 is slidably disposed in the cylinder 880 and the cylinder member 872 and is characterized by a tubular piston rod 890 which is suitably connected at its opposite ends to piston 892 and 894, respectively. The piston 894 is slidably disposed in the cylinder member 880 and divides the cylinder member into upper and lower chambers 896 and 898, respectively. In a similar manner the piston assembly 892 forms, in part, a chamber 900 and a chamber 902 in the cylinder 872. The chamber 902 is in communication with the fluid inlet passage 878 and the chamber 900 is in communication with an elongated passage 904 in the piston rod 890, which passage is in communication with the chamber 896 and a passage 906 extending up through the head member 882, the conduit 884 and the connector member 838 to be in communication with the passage 844 and the production fluid conduit 26.

The piston assembly 892 is adapted to include closely spaced ball type one way check valves 908 and 910, respectively. The valve 910 is operable to seat over a passage 912 formed in a piston packing retaining nut 914. The passage 912 is in communication with the chamber 902 for transferring well fluid from that chamber to the chamber 900 through passages 914 and 916 during a downstroke of the piston assembly 888. In like manner, the check valve 908 is operable to communicate the chamber 900 with the passage 906 in the piston rod 890 by way of the passages 914 and 916 formed in the piston 892. Suitable piston ring seals or packing 918 is provided on the piston 892 and a nut member 920 is operable to secure the piston 892 to the piston rod 904. The rod 904 is suitably sealed by conventional packing or seals 922 interposed in a bore 923 formed in the partition member 868 to seal the chamber 900 from communication with the chamber 898. A packing nut 924 is threadedly engaged with the partition 868 to retain the packing 922 therein. The piston 894 is also provided with suitable packing 919 for sealing engagement with the bore wall of the cylinder member 880 to prevent fluid flow between the chambers 896 and 898. The upper end of the piston 894 is provided with a removable upstroke stop member 930 having passage means 931 formed therein for communicating the passage 906 with the chamber 896 even if the stop member is engaged with a flange 934 formed on the head member 882.

Referring still further to FIG. 16B, pump driving fluid is admitted to the chamber 898 for urging the piston 894 in an upward direction, viewing FIG. 16B, by way of passages 940 which are in communication with an annular passage 942 formed between the outer surface of the cylinder member 880 and the inner bore of the cylinder member 866. The passage 942 opens into a liquid reservoir chamber 943 which is in communication with a passage 944 formed in the head member 838. The passage 944 opens into accumulator gas chamber 846. A branch passage 946 opens to the exterior of the connector member 838 for relieving the pressure of gas charged into the chamber 846 upon disconnection of the connector member 838 from the cylinder 806. The head member 882 is provided with a transverse bore 950 in which a spring 951 is retained by a plug 953 and biases a valve closure member 952 to close a port 954. The port 954 opens from the passage 906 into the chamber 943 by way of a passage 958. In the event that it is necessary to replenish the quantity of driving fluid used in the pump 802 the well production fluid may be suitably pressurized to the extent that the valve 952 unseats to admit fluid into the driving fluid chamber 943. Of course, some quantity of driving fluid may be present in the chamber 846 although primarily this chamber is charged with gas to form the gas charged accumulator function and the gas-liquid interface is maintained in chamber 943.

The operation of the pump 802 is believed to be understandable from the foregoing description, however, briefly, the pump 802 is operated by the displacement of production fluid from the conduit 26 into the chamber 896 to act against the upper transverse end face of the piston 894 to displace the piston assembly 888 downward increasing the volume of chamber 900 at which time the valve 910 unseats to allow well fluid to enter expanding chamber 900 from contracting chamber 902 by way of passages 914 and 916. Production fluid in the passage 906 maintains the check valve 908 seated to prevent flow of fluid between the passage 916 and the passage 906. During displacement of the piston assembly 888 downward the chamber 898 is contracting in volume to force driving fluid back into the annular passage 942 at least slightly compressing gas in the chamber 846 depending, of course, on the volume of the chamber.

When the piston assembly 888 reaches the bottom of its stroke and the power transfer unit 810 reverses the direction of movement of the pistons 468 and 472 pressure fluid acting on the lower transverse face of the piston 894 urges the piston assembly 888 upwardly displacing fluid from the chamber 900 into the passage 906 by way of the check valve 908 and drawing a fresh charge of production fluid into the chamber 902, all the while the check valve 910 being in a closed position. The displacement of the chamber 900 is greater than the chamber 818 of power transfer unit 810 and a net amount of well production fluid is displaced through the conduit 482 into the storage tank 481 until the valve 484 is energized to close whereby movement of the piston 472 in the opposite direction to reduce the volume of chamber 818 will again drive the piston assembly 888 in a downward direction as production fluid is oscillated in the conduit 26.

The pump 802 is particularly advantageous in that a well can be completed and pumped without the use of the driving fluid conduit 24 resulting in substantial capital savings. Another advantage of the pump 802 is that the compression of gas in the chamber 846 during each stroke of the pump will result in some heating of the gas which heat will transfer to the working portions of the pump cylinder 804 as well as to the fluid flowing through the passage 844 which will prevent the buildup of undesirable waxes and paraffing in these passages and also assist in the delivery of particularly viscous well fluids through the conduit 26.

Installation of the pump 802 may be carried out from the surface using conventional downhole tool handling techniques. Prior to insertion of the pump 802 into the wellbore 14 the passages 940 and 942 are filled with clean driving fluid such as a refined oil, the cylinders 804 and 806 are coupled together and the chamber 846 is then charged with a quantity of pressure gas at a desired working pressure. The amount of compression of gas in the chamber 846 is, of course, dictated by the displacement of the chamber 898 and the volume of chamber 846. This can be predetermined to minimize the compression of the gas in the accumulator chamber 846 during actuation of the pump. The operation of the power transfer unit 810 is virtually identical to that of the power transfer unit 452 with the exception that the chamber 820 is in communication with the wellbore 14 to reduce the pressure therein and to scavenge any gas for transfer to a discharge line 822.

Figure 17A:
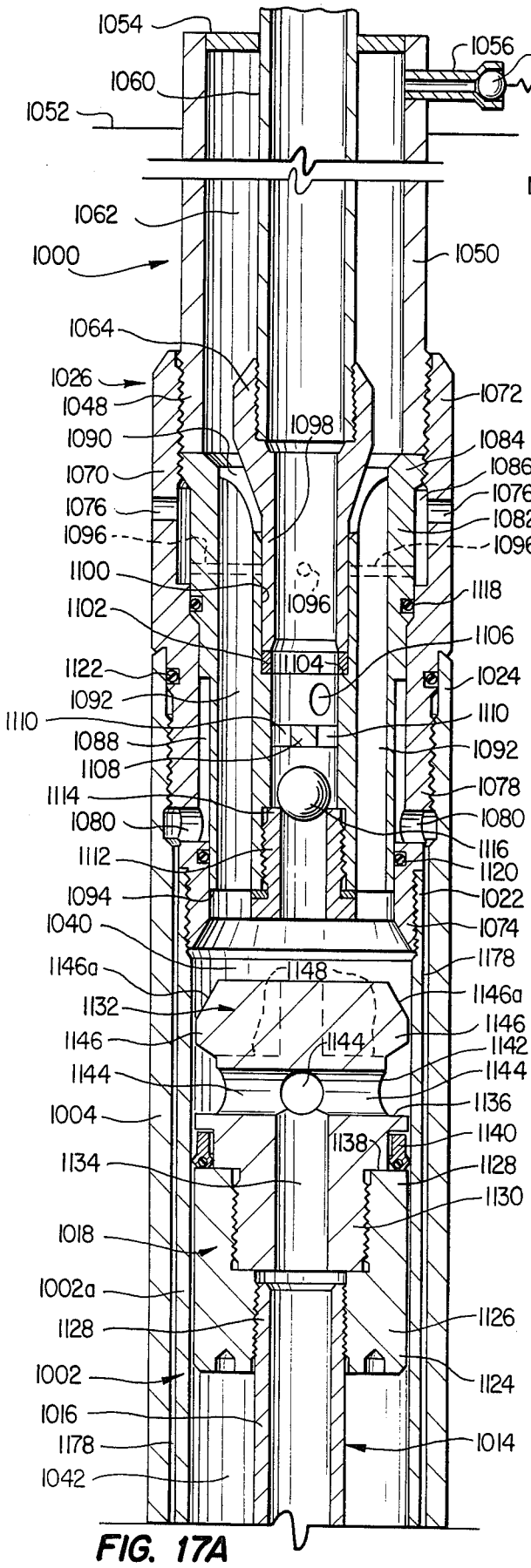
FIGS. 17A and 17B are cross-sectional views through longitudinal portions of a further alternate embodiment of a well pump incorporating principles of the present invention.
Figure 17B:
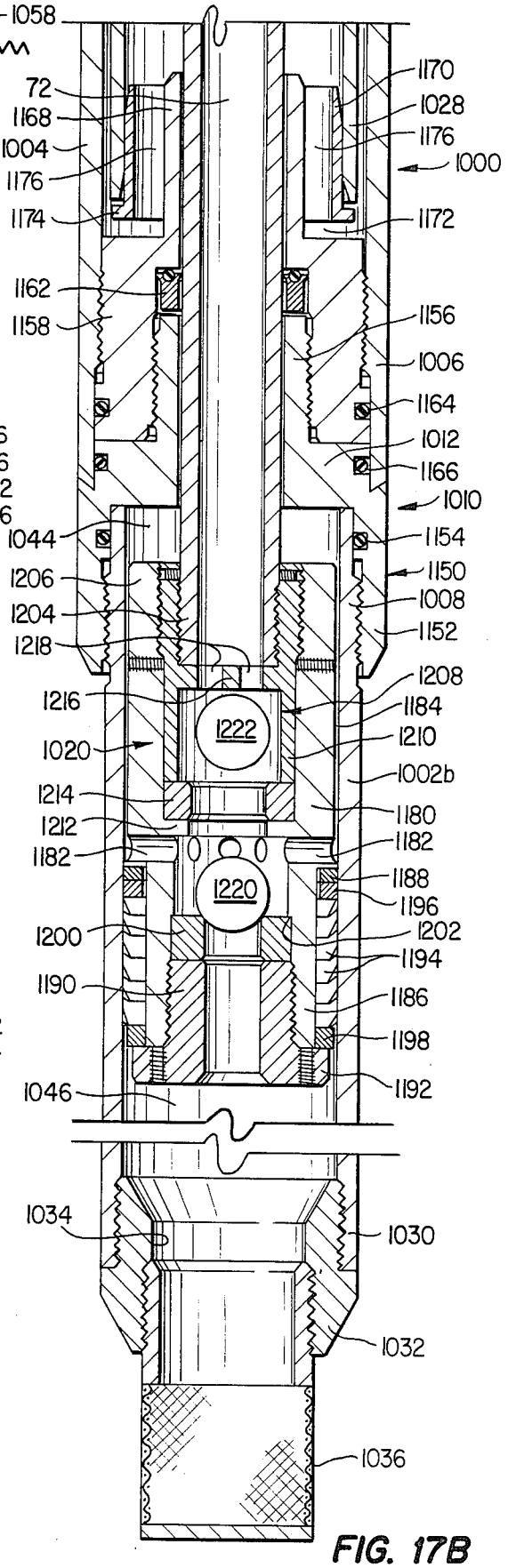

Cross-sectionally illustrated in FIGS. 17A and 17B are longitudinal sections of a further alternate embodiment 1000 of the downhole pump. The operation of pump 1000 is similar to that of pump 12 shown in FIGS. 1–5, and like pump 12, pump 1000 is insertible in a well bore (not shown in FIGS. 17A and 17B) and is hydraulically drivable to pump production fluid to the surface. Compared to pump 12, however, pump 1000 has a variety of structural modifications which will now be described.

Pump 1000 includes an elongated tubular pump housing or barrel 1002 having an upper section $\mathbf{1002}_a$ which is circumscribed by a tubular outer shell 1004, and a lower section $\mathbf{1002}_b$ which is connected to and projects downwardly from the shell 1004. Interposed between and interconnecting the lower end 1006 of shell 1004 and the upper end 1008 of barrel section $\mathbf{1002}_b$ is a divider assembly 1010 which defines within the interior of pump barrel 1002 an annular partition 1012. Piston means 1014 are provided within the interior of the pump barrel 1002 and include an elongated, hollow piston tube 1016 which extends through and is slidably received within the partition 1012. Secured to the upper end of tube 1016 is an upper or power piston assembly 1018, and secured to the lower end of tube 1016 is a lower or lift piston assembly 1020. The upper ends 1022, 1024 of the barrel section $\mathbf{1002}_a$ and the shell 1004 are respectively secured to an upper head or cap assembly 1026, with the lower end 1028 of barrel section $\mathbf{1002}_a$ being positioned slightly above the lower end 1006 of the shell 1004. Threaded into the lower end 1030 of barrel section $\mathbf{1002}_b$ is an inlet fitting 1032 having an inlet opening 1034. Threaded into inlet opening 1034 is the upper end of a conventional sand filter 1036.

The upper piston assembly 1018 is slidably mounted within the interior of the upper barrel section $\mathbf{1002}_a$ and divides it into a production fluid transfer chamber 1040 disposed between piston assembly 1018 and head assembly 1026, and a driving fluid chamber 1042 disposed between the piston assembly 1018 and the annular partition 1012. The lower piston assembly 1020 is slidably mounted within the interior of the lower barrel section $\mathbf{1002}_b$ and divides it into a production fluid delivery chamber 1044 disposed between the lower piston assembly 1020 and the partition 1012, and a production fluid intake chamber 1046 positioned between the lower piston assembly 1020 and the inlet fitting 1032.

Connected at its lower end 1048 to the upper head assembly 1026 is a production fluid pipe 1050 which extends upwardly through the wellbore to above the earth's surface 1052 and is closed at its upper end with a suitable cap 1054. Extending outwardly from the pipe 1050 at its upper end is a production fluid supply conduit 1056 having a spring-loaded check valve 1058 operatively disposed in its outer end.

The pump 1000 is hydraulically driven, in a manner subsequently described, by means of a driving fluid which is intermittently forced through a driving fluid pipe 1060 which extends downwardly through a central portion of the production fluid pipe 1050 and defines therewith an annular flow passage 1062 through which production fluid is upwardly pumped for discharge through the supply conduit 1056. Threaded onto the lower end of the driving fluid pipe 1060 is an annular stabber member 1064 which, in a manner subsequently described, engages the upper head assembly 1026. In operating the pump 1000, production fluid is preferably used as the driving fluid within the driving fluid pipe 1060. However, a driving fluid having a different specific gravity than that of the production fluid could be used if desired.

Referring first the FIG. 17A, the structural modifications in the pump 1000 will now be described. The upper head assembly 1026 includes a hollow, generally cylindrical body 1070 which has an internally threaded upper end portion 1072 into which is threaded the lower end of the production fluid pipe 1050, an externally threaded lower end portion 1074 onto which is threaded the upper end of barrel section $\mathbf{1002}_a$, a circumferentially spaced series of small drain ports 1076 positioned below the body upper end 1072, an externally threaded longitudinally intermediate portion 1078 onto which the upper end of shell 1004 is threaded, and a circumferentially spaced series of crossover outlet ports 1080 positioned between the body portions 1074 and 1078.

Coaxially received within the body 1070 is a hollow cylindrical crossover fitting 1082 which has an externally threaded upper end portion 1084 which is threaded into the upper body end 1072 below the production fluid pipe 1050. The fitting 1082 defines with the body 1072 an annular drain passage 1086 which communicates with the drain ports 1076, and an annular crossover passage 1088 which communicates with and extends upwardly from the crossover outlet ports 1080.

An upper end portion 1090 of the interior surface of fitting 1082 is conically downwardly tapered and has formed therethrough a circumferentially spaced series of downwardly extending production fluid outlet passages 1092 which extend through the bottom end 1094 of fitting 1082 and communicate with the production fluid transfer chamber 1040. Extending laterally outwardly through the interior surface of fitting 1082 just below the tapered interior surface portion 1090 are a circumferentially spaced series of interior drain ports 1096 which are positioned between the passages 1092 and communicate with the annular drain passage 1086.

As illustrated, a lower end portion 1098 of the annular stabber member 1064 is closely received within a cylindrical interior surface portion 1100 of the crossover fitting 1082 which extends downwardly from the tapered interior surface 1090 and has formed therethrough the interior drain ports 1096. The stabber member portion 1098 blocks the interior drain ports 1096 and engages at its lower end a compressible ferrule 1102 which rests upon an annular interior ledge 1104 formed within the crossover fitting. Extending laterally outwardly from the crossover fitting interior surface directly below ledge 1104 are a circumferentially spaced series of crossover inlet passages 1106 which extend between the production fluid outlet passages 1092 into the annular crossover passage 1088. Immediately below the passages 1106 the interior of the crossover fitting 1082 has a cylindrical partition 1108 which has around its periphery a circumferentially spaced series of passages 1110. Threaded into the lower end 1094 of the crossover fitting, radially inwardly of the passages 1092, is an annular valve seat 1112 which has an upper end 1114 that is spaced downwardly from the partition 1108. A metal ball 1116 is operatively carried by the valve seal 1112 for travel between its upper end 1114 and the partition 1108. The crossover fitting 1082 is sealed to the head assembly body 1070 by means of O-ring seals 1118 and 1120, and the body 1070 is sealed to the upper end 1024 of shell 1004 by means of an O-ring seal 1122.

Figure 18:
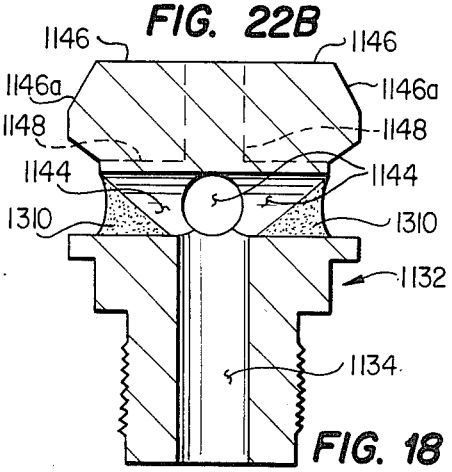
FIG. 18 is a cross-sectional view through the upper piston assembly dome portion of the pump illustrated in FIG. 17A.
Figure 19:
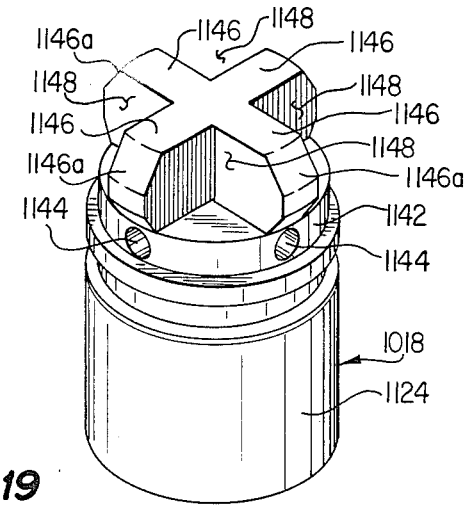
FIG. 19 is a reduced scale perspective view of the upper piston assembly.

Referring now to FIGS. 17A, 18 and 19, the upper piston assembly 1018 includes an annular lifter member 1124 having an interiorly threaded lower end portion 1126 into which is threaded an upper end portion 1128 of the piston tube 1016, and an interiorly threaded upper end portion 1128 which has a somewhat larger inner diameter. The lower end portion 1130 of a piston dome member 1132 is threded into the upper end portion 1128 and has a central axial bore 1134 formed therein which communicates with the interior of the piston tube 1016. An upper end portion 1136 of the piston dome 1132 overlies the annular upper end 1138 of lifter member 1124 and is sealed thereto by means of a suitable annular seal member 1140. A circumferential groove 1142 is formed in the upper lifter member portion 1136 above the seal 1140 and has formed therein four equally circumferentially spaced, laterally extending outlet ports 1144 which communicate with the bore 1134. At the upper end of the piston dome 1132 are four circumferentially spaced, radially extending flutes 1146 which define therebetween four generally wedge-shaped upper end surface depressions 1148. Each of the flutes 1146 overlies and projects radially outwardly beyond one of the outlet ports 1144, and has an upwardly and inwardly tapered upper corner portion 1146$_a$.

Referring now to FIG. 17B, the divider assembly 1010, through which the piston tube 1016 slidably passes, includes a hollow cylindrical adapter fitting 1150 having an interiorly threaded lower end portion 1152 into which is threaded the upper end portion 1008 of the lower barrel section 1002$_b$, such upper end portion 1008 being sealed to the adapter fitting 1152 by means of an annular seal 1154. An annular upper end portion 1156 of the adapter fitting 1150 is threaded into the interior of an annular lower end portion 1158 of a body member 1160 and is interiorly sealed thereto by means of an annular seal member 1162. The lower end portion 1006 of the pump shell 1004 circumscribes and is threaded onto the lower end portion 1158 as illustrated, and is sealed to body portion 1158 and the adapter fitting 1150 by means of annular seals 1164 and 1166.

Projecting upwardly from the lower end portion 1158 of the body member 1160 is an annular upper end portion 1168 which has formed integrally therewith a laterally outwardly projecting annular dome portion 1170 which is spaced upwardly from the lower body end portion 1158 and defines therewith an annular space 1172. At the lower end of the dome 1170 is an annular, outwardly projecting flange 1174 which has an outer diameter somewhat less than the outer diameter of the lower body end portion 1158. Extending vertically through the dome 1170 is a circumferentially spaced series of passages 1176 which intercommunicate the annular space 1172 with the driving fluid chamber 1042. As illustrated, the lower end 1028 of the upper pump barrel section 1002$_a$ outwardly circumscribes and engages the dome 1170, with the lower end of barrel section 1002$_a$ being positioned slightly above the dome flanges 1174. The upper barrel section 1002$_a$ defines with the pump shell 1004 an annular, vertically extending passage 1178 which communicates at its lower end with the annular space 1172 (FIG. 17B) and communicates at its upper end with the crossover outlet ports 1080 (FIG. 17A).

As illustrated in FIG. 17B, the lower piston assembly 1020 includes an annular piston body 1180 having a circumferentially spaced series of inlet ports 1182 extending through a longitudinally central portion thereof. The lower piston body 1180 has a maximum outer diameter slightly less than the inner diameter of the lower barrel section 1002$_b$ and defines therewith an annular passage 1184 which communicates at its lower end with the piston inlet ports 1182, and communicates at its upper end with the production fluid delivery chamber 1044. A lower end portion 1186 of the piston body 1180 is of a reduced diameter and defines an annular external shoulder 1188 immediately below the inlet ports 1182. An annular seat and seal retainer member 1190 is threaded into the bottom of the piston body portion 1186 and has an annular external flange 1192 which projects radially outwardly of the piston body portion 1186. Piston body portion 1186 is slidably sealed to the inner surface of lower barrel section 1002$_b$ by means of a plurality of annular seal members 1194 which are retained between a pair of step cut rings 1196 which engage the shoulder 1188, and an annular seal lifter 1198 which engages the retainer member flange 1192. An annular valve seat 1200 is captively retained within the interior of the annular piston body 1180 between the upper end of the retainer member 1190 and an annular, interior shoulder 1202 of the piston body.

A lower end portion 1204 of the piston tube 1016 is threaded into an upper portion 1206 of an annular piston lifter and cage 1208, portion 1206 being in turn threaded into an upper end portion of the lower piston body 1180. Extending downwardly from the upper end portion 1206 of the lifter and cage member 1208 is an annular skirt 1210 which terminates slightly above an annular internal flange portion 1212 of the piston body 1180, flange 1212 being positioned immediately above the piston inlet ports 1182. An upper annular valve seat 1214 is captively retained between the lower end of skirt 10 and the internal flange 1212. At the juncture of its upper end portion 1206 and its downwardly extending skirt 1210 the piston lifter and cage member 1208 is provided with a cylindrical internal partition 1216 which has a circumferentially spaced series of vertically extending holes 1218 formed therethrough, the holes 1218 intercommunicating the interior of the piston tube 1016 with the interior of the downwardly extending skirt 1210.

Captively retained within the interior of the lower piston body 1180 for movement between the lower valve seal 1200 and the internal flange 1212 is a lower metal valve ball 1220. Captively retained within the skirt 1210 for movement between the upper annular valve seat 1214 and the internal partition 1216 is an upper metal valve ball 1222.

The operation of pump 1000 is similar in principle to that of the pump 12 depicted in FIGS. 1-5. With the piston means 1014 at the lower limit of their downstroke, additional driving fluid is forced into the driving fluid pipe 1060 in a manner subsequently described. The fluid pressure increase in the pipe 1060 is transmitted to the annular undersurface of the upper piston assembly 1018 via the crossover passages 1106, 1088 and 1080, the elongated vertical annular passage 1178, the divider assembly passages 1172 and 1176, and the driving fluid chamber 1042. The increased fluid pressure in the driving fluid chamber 1042 drives the piston means 1014 upwardly in the pump barrel 1002. During upward movement of the piston means, the lower piston assembly valve ball 1220 is seated on its valve seat 1200 by virtue of the increasing pressure in the production fluid delivery chamber 1044, and the valve ball 1222 is lifted from its valve seat 1214.

Production fluid squeezed out of the production fluid delivery chamber 1044 is forced upwardly into the annular space 1062 between the production fluid pipe 1050 and the driving fluid pipe 1060 via the annular passage 1184, the lower piston inlet ports 1182, the interior of valve seat 1214, the vertical partition holes 1218, the interior of piston tube 1016, the upper piston outlet ports 1144, the gaps between the upper piston flutes 1146, the production fluid transfer chamber 1040, and the production fluid outlet passages 1092 in the crossover fitting 1082 of the head assembly 1026. Production fluid entering the annular flow passage 1062 is forced outwardly through the production fluid supply conduit 1056. When the pressure of the driving fluid within the driving fluid pipe 1060 is increased to drive the piston means 1014 upwardly as just described, the head assembly ball 1116 is normally driven into sealing engagement with its valve seat 1112. However, the ball 1116 and its seat 1112 function as a recirculating valve which permits upward flow of production fluid from the production fluid transfer chamber 1040 through the seat 1112 in the event that the fluid pressure on the underside of ball 1116 exceeds the downward driving fluid pressure on the upper surface of the ball.

During downward movement of the piston means 1014 the lower piston assembly ball 1222 is seated on its valve seat 1214, and the ball 1220 is lifted from its seat 1200. Accordingly, production fluid from the production fluid intake chamber 1046 is forced upwardly through the interior of retainer member 1190, outwardly through the lower piston ports 1182 and into the production fluid delivery chamber 1044 via the annular passage 1184 to refill the chamber 1044. Simultaneously, driving fluid from the driving fluid chamber 1042 is flowed back into the driving fluid pipe 1060 via the annular passage 1178 and the crossover passages 1080, 1088 and 1106.

Figure 20:
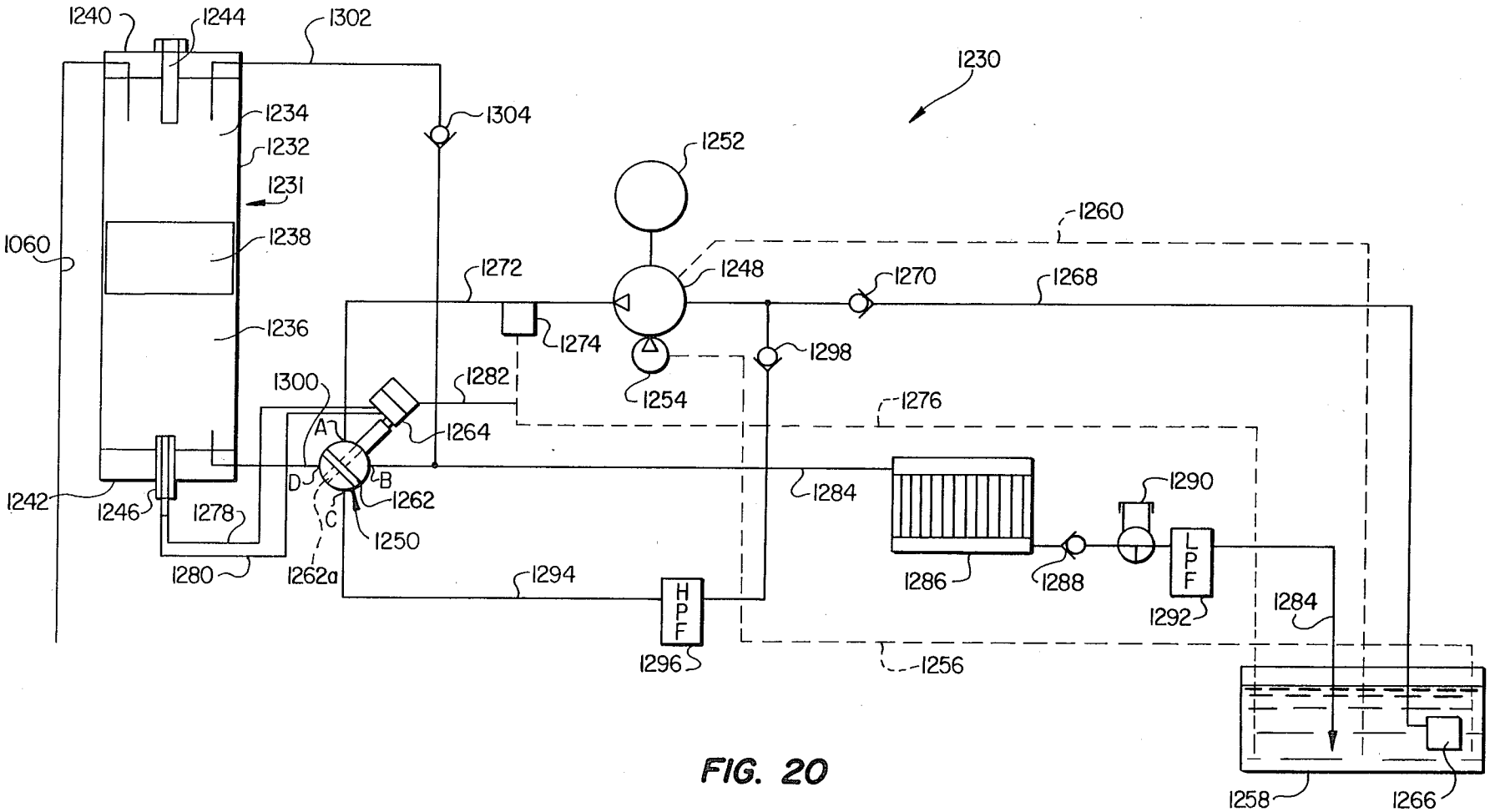
FIG. 20 is a schematic diagram of a power transfer system used to hydraulically drive the pump of FIGS. 17A and 17B.

The pump 1000 is hydraulically driven by a power transfer system 1230 located above-ground adjacent the wellhead and schematically depicted in FIG. 20. System 1230 includes an accumulator 1231 having a hollow isolator housing 1232 filled with driving fluid and having a cylindrical interior which is divided into upper and lower chambers 1234, 1236 by a piston 1238 operatively disposed therein for reciprocating motion toward and away from the housing's opposite upper and lower ends 1240, 1242. The upward travel of piston 1238 may be selectively limited by an adjustable travel stop 1244 mounted on the upper housing end 1240, while the proximity of piston 1238 to the lower end wall 1242 is sensed by a proximity sensor 1246 secured thereto.

Piston means 1014 of pump 1000 are upwardly driven, via the power transfer system piston 1230, by means of a variable volume, closed loop, driving fluid pump 1248 that operates in conjunction with a reversible four-way valve 1250. Pump 1248 is driven by a motor 1252 and has operatively connected thereto a charge pump 1254 that functions in a conventional manner to replenish leakage in the pump 1248. The charge pump 1254 has an inlet conduit 1256 connected at its open outer end to a driving fluid reservoir 1258, and a discharge conduit 1260 interconnected between the inlet side of pump 1248 and the reservoir 1258.

The valve 1250 has four ports A, B, C and D, and a schematically depicted internal member 1262 which is movable by a switch 1264 between a first position (shown by solid lines in FIG. 20) in which ports A and B communicate, and ports C and D communicate, and a second position (shown by dotted lines in FIG. 20 and indicated by the reference numeral $1262_a$) in which ports A and D communicate, and ports B and C communicate.

Interconnected between the inlet of pump 1248 and a suction strainer 1266 disposed in the reservoir 1258 is an inlet conduit 1268 which has a check valve 1270 installed therein. Connected between the outlet side of pump 1248 and port A of valve 1250 is a pump discharge conduit 1272. A pressure relief valve 1274 is installed in the discharge conduit 1272 and has a discharge line 1276 which is extended into the driving fluid reservoir 1258. A pair of outlet leads 1278, 1280 from the proximity sensor 1246 are operatively connected to the valve switch 1264 which also has a sensing conduit 1282 connected to the pressure relief valve discharge line 1276.

A conduit 1284 is connected to port B of the valve 1250 and is extended into the reservoir 1258, the conduit 1284 having operatively installed therein, in a left-to-right sequence in FIG. 20, a full flow oil cooler 1286, a check valve 1288, a manual three-way filler valve 1290, and a low pressure filter (LPF) 1292. Interconnected between port C of valve 1250 and the pump inlet conduit 1268 between the pump 1248 and the check valve 1270 is a conduit 1294 which has operatively installed therein a high pressure filter (HPF) 1296 and a check valve 1298. Extending from port D of the valve 1250 into the lower chamber 1236 of the housing 1232 is a conduit 1300. Finally, a fluid make-up conduit 1302 is interconnected between the upper chamber 1234 of housing 1232 and the conduit 1284 between the valve 1250 and the oil cooler 1286, the conduit 1302 having operatively installed therein a check valve 1304.

With the piston means 1014 of pump 1000 in their lowermost position within the pump barrel, the piston 1238 is in its lowermost position within the housing 1232 and the proximity sensor 1246, via the leads 1278, 1280 and the valve switch 1264 has moved the internal member 1262 of valve 1250 to its second position $1262_a$. The pump 1248 draws driving fluid from the reservoir 1258 through the inlet conduit 1268 and check valve 1270, and discharges the fluid via the discharge conduit 1272, the ports A and D of the valve 1250 and the conduit 1300 into the lower chamber 1236 of the housing 1232. Driving fluid forced into the lower chamber 1236 forces the piston 1238 upwardly toward the travel stop 1244. Such upward travel of the piston 1238 forces driving fluid from the upper chamber 1234 into and downwardly through the driving fluid pipe 1060 into the pump 1000 to thereby force the piston means 1014 upwardly in the barrel of the pump 1000.

As the piston means 1014 approach the upper limit of their stroke, the housing piston 1238 approaches the upper limit of its stroke within the housing 1232 and the fluid pressure in the pump discharge conduit 1272 is increased to an extent that the pressure relief valve 1274 opens and flows pump discharge fluid into the reservoir 1258 via the pressure relief valve discharge line 1276. The increased pressure in discharge line 1276 is sensed by the sensing conduit 1282 which energizes the valve switch 1264 to move the valve internal member 1262 to its first position.

A significant portion of the potential energy stored in the piston means 1014 at the upper end of their stroke is now recaptured and utilized to reduce the overall power consumption of the pump 1248 in the following manner. With the four-way valve 1250 switched to its first position, the piston means 1014 are simply allowed to slowly fall through their downstroke within the barrel of pump 1000. As such piston means slowly fall, driving fluid is forced upwardly through the driving fluid pipe 1060 and into the upper chamber 1234 of the isolator housing 1232. Driving fluid forced into the upper chamber 1234 forces the piston 1238 downwardly within the housing 1232. Downward movement of the piston 1238 forces driving fluid outwardly from the lower chamber 1236 and into the inlet of pump 1248 via the conduit 1300, the ports D and C of the valve 1250, the conduit 1294, the check valve 1298, and the inlet conduit 1268. Driving fluid, now pressurized by the falling piston means 1014, enters and is forced through the pump 1248 and into the driving fluid reservoir 1258 via the discharge conduit 1272, ports A and B of the valve 1250 and the conduit 1284. Depending on the relative pressures involved, a portion of this driving fluid may be forced upwardly through the make-up conduit 1302 into the upper housing chamber 1234.

It can be seen that the driving fluid forced into and through the pump 1248 by the falling piston means 1014 serves to reduce the power consumption on the pump motor 1252 during this half of the operating cycle of system 1230, thereby increasing the overall power consumption efficiency of the system. As the piston 1238 downwardly approaches the proximity sensor 1246, the sensor energizes the valve switch 1264 to return the valve's internal member 1262 back to its second postion $1262_a$, and the previously described operating cycle of the system 1230 begins again.

As previously mentioned, the unique structural features incorporated into the pump 1000 provide it with various operating advantages which will now be described. Referring first to FIGS. 18 and 19, the circumferentially spaced flutes 1146 on the dome portion 1132 of the upper piston assembly 1018 function to substantially impede the entry of sand 1310 into the vertical piston dome bore 1134 during the downstroke of piston means 1014 while production fluid is being drawn into the ports 1144 from the production fluid transfer chamber 1040. Since each of the flutes 1146 overlies one of the ports 1144 and projects radially beyond it, the flutes function as "barriers" to shelter the direct entry into the ports of residual sand or other sediment in the chamber 1040. Such residual sand will instead be drawn primarily into the circumferential portions of groove 1142 disposed between the ports 1144. Although a small portion of this sand disposed within such groove portions will be drawn into the ports 1144 in opposite circumferential directions, the sand 1310 will assume an approximately 45° repose angle on the lower surfaces of the ports 1144 with the sand buildup in each of the ports 1144 stopping short of the bore 1134 as illustrated in FIG. 8. The positional and configurational relationships between the flutes 1146 and the ports 1144 thus substantially inhibits the entry of sand 1310 into the bore 1134 to thereby minimize sand abrasion on the valve balls 1220 and 1222. On each upstroke of the piston means 1014 any sand 1310 resting on the lower surfaces of the ports 1144 is flushed away by the outflow of production fluid through such ports.

The valve balls 1220 and 1222 are further protected from sand abrasion by the sand filter 1036 which is uniquely back flushed during each downstroke of the piston means 1014. More specifically, although well fluid enters the production fluid intake chamber 1046 during the upstroke of the piston means 1014, true pump intake takes place in the production fluid delivery chamber 1044 during the downstroke of the piston means. Approximately ten percent of the well fluid drawn into the chamber 1046 during the piston means upstroke will be expelled from the chamber 1046 during the downstroke of the piston means, thereby backflushing the sand filter during each downstroke of the piston means to thereby limit sand buildup on the filter and entry therethrough.

The pump 1000 also uniquely functions to maintain the piston tube 1016 under constant tension during both the upstroke and downstroke of the piston means 1014 to thereby prevent side-to-side flutter of the upper and lower pistons and the piston tube. During the upstroke of the piston means, the piston tube is maintained in tension by means of the driving fluid pressure exerted on the annular undersurface of the upper piston assembly 1018. As the piston means fall through their downstroke, the standing column of production fluid within the pump exerts a net downward force on the lower piston assembly 1020 equal to the pressure of the column adjacent ball 1222 times the projected internal area of the upper valve seat 1214, as can be deduced by summing the various fluid pressure forces on the previously described pump components.

Figure 21A:
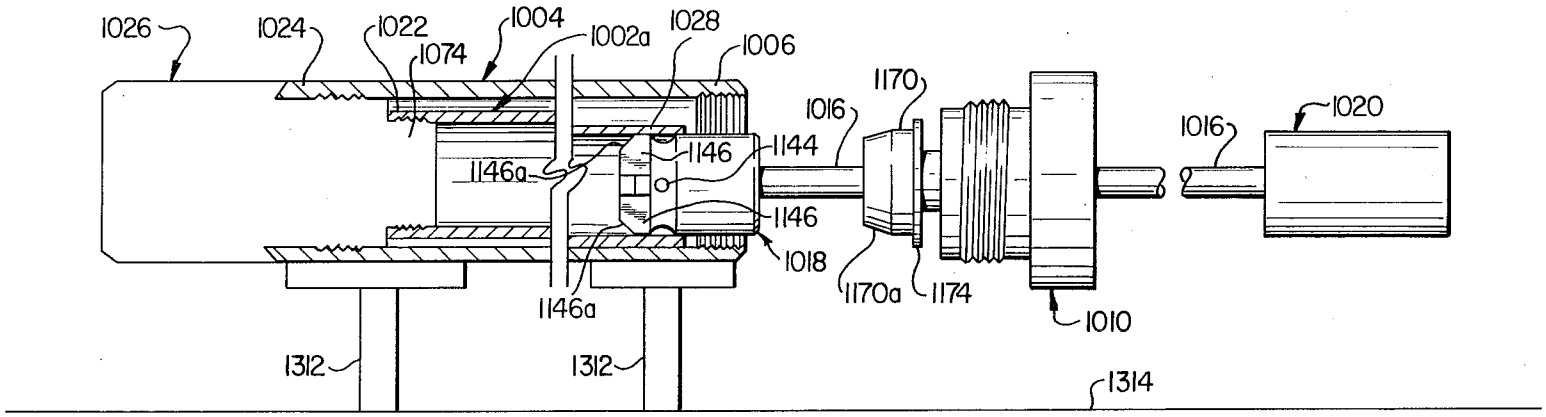
FIGS. 21A and 21B are simplified fragmentary views of the upper half of the pump of FIGS. 17A and 17B, partially in cross-section and partially in elevation, and illustrate a unique horizontal assembly method therefor.
Figure 21B:
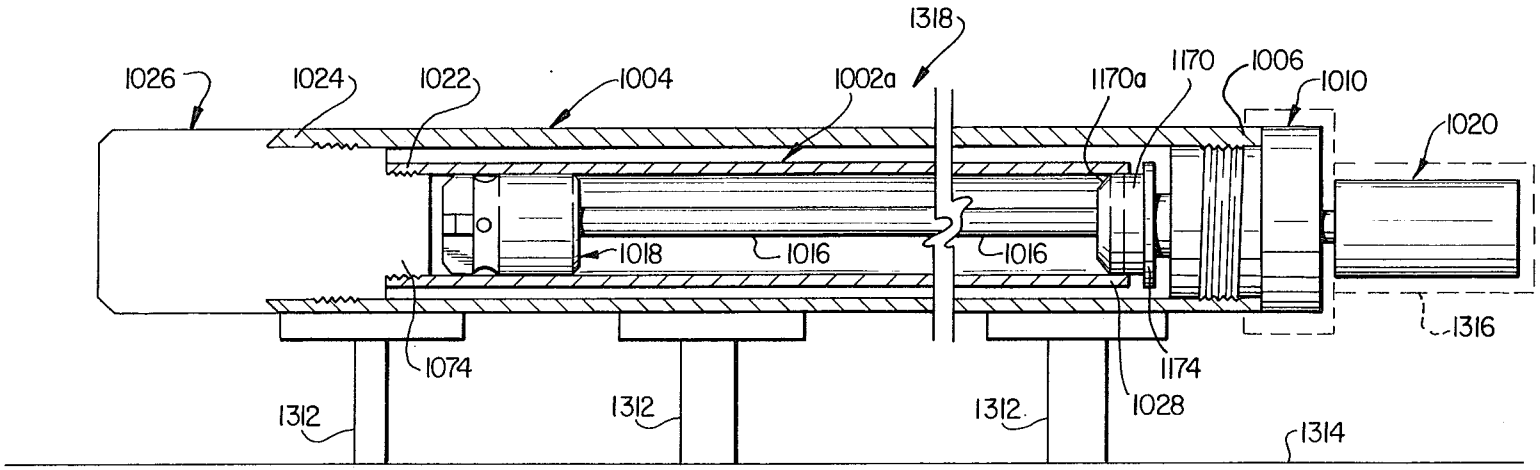

The illustrated pump 1000 is approximately sixty feet long, the lower pump barrel section $1002_b$ constituting approximately half of that length. It can readily be seen that to assemble the pump in a vertical orientation in a factory or other production facility would require a floor-to-ceiling height of over sixty feet—a vertical space requirement which, in many production facilities, is simply not available. However, various structural features of the pump 1000 render it uniquely adaptable to a horizontal assembly method which will now be described with reference to FIGS. 21A and 21B.

The horizontal assembly method is used to fully assemble the upper half of the pump 1000 and is initiated by horizontally supporting the pump shell 1004 on a series of suitable support members 1312 (FIG. 21A) resting on the assembly facility floor 1314. The upper barrel section $\mathbf{1002}_a$ is inserted leftwardly through the shell 1004 and the threaded connections are made between the head assembly 1026 and the upper end portion 1024 of the shell 1004, and between the upper end portion 1022 of the upper barrel section $\mathbf{1002}_a$ and the lower head body end portion 1074. After these connections are made, it can be seen that the lower end portion 1028 of the upper barrel section $\mathbf{1002}_a$ rests upon the lower interior surface of the horizontal shell 1004 and is positioned slightly inwardly of the lower end portion 1006 of shell 1004.

The left end of the piston tube 1016 is then threaded into the upper piston assembly 1018 and the right end of the piston tube extended through the divider assembly 1010 and threaded into the lower piston assembly 1020. Next, the upper piston assembly 1018 is inserted leftwardly into the end 1006 of the shell 1004 and into the open end 1028 of the upper barrel section $\mathbf{1002}_a$. The tapered flute portions $\mathbf{1146}_a$ of the piston assembly 1018 guide the upper piston into the barrel section $\mathbf{1002}_a$ and function to lift i slightly off the interior surface of shell 1004 as the piston tube 1016 is pushed leftwardly through the barrel section $\mathbf{1002}_a$. As the piston tube 1016 continues to be pushed in a leftward direction (FIG. 21B) the upper piston assembly 1018 is moved into close adjacency with the head assembly 1026 and the lower piston assembly 1020 and the divider assembly 1010 are positioned slightly outwardly of the lower end 1006 of the shell 1004.

Next, the divider assembly 1010 is lifted slightly and threaded onto the end 1006 of the shell. While this threaded connection is being tightened, the divider assembly dome 1170 is advanced leftwardly into the end 1028 of the barrel section $\mathbf{1002}_a$, the tapered dome surface $\mathbf{1170}_a$ guiding the dome 1170 into the barrel section $\mathbf{1002}_a$ and moving the dome flange 1174 to its final spaced position relative to the lower barrel end 1028 as illustrated. When the divider assembly 1010 is completely tightened onto the shell 1004, a protective cap 1316 is installed over the lower piston assembly 1020 and the outwardly projecting portion of the divider assembly 1010. The horizontal assembly of the pump components just described forms an upper pump portion subassembly 1318 which may be conveniently shipped to the well site along with the lower barrel section $\mathbf{1002}_b$.

When the subassembly 1318 and the lower barrel section $\mathbf{1002}_b$ arrive at the well site, the pump 1000 is installed in the well bore in the following manner. First, the lower barrel section $\mathbf{1002}_b$ is partially lowered into the well bore. Next, the protective cap 1316 is removed and the subassembly 1318 is tilted upwardly to a vertical position directly above the lower barrel section. The lower piston assembly 1020 is then lowered into the lower barrel section and the lower barrel section is threaded into the divider assembly 1010 to complete the on-site portion of the pump assembly. Next, a section of production fluid pipe 1050 is threaded into the head assembly and the pump is lowered further into the well bore. Successive sections of pipe 1050 are then added and the pump is progressively lowered to its proper depth within the well bore.

The pipe stabber 1064 is then threaded onto a section of driving fluid pipe 1060 and inserted downwardly into the production fluid pipe 1050. Additional sections of driving fluid pipe are then added and the stabber member progressively lowered in the outer production fluid pipe 1050 toward the pump head assembly 1026. As the stabber enters the head assembly, the conically tapered interior surface 1090 of the crossover fitting 1082 (FIG. 17A) engages the stabber, automatically centers it, and guides it into proper engagement with the cylindrical surface 1100 of the crossover fitting. With the pump 1000 assembled and installed in this manner, the interconnections between the pump and the power transfer system 1230 may then be made.

In the event that removal of the pump 1000 from the wellbore is required, the driving fluid pipe 1060 may be removed in a "dry" condition due to a unique cooperation between the stabber member 1064 and the interior drain ports 1096. As previously mentioned, the stabber member in its normal position blocks these drain ports. However, when the lower end portion 1098 of the stabber member is lifted above the drain ports 1096, the column of driving fluid within pipe 1060 is caused to drain outwardly through the head assembly 1026 via the drain ports 1096, the annular drain passage 1086, and the drain ports 1076 formed in the head assembly.

Figure 22A:
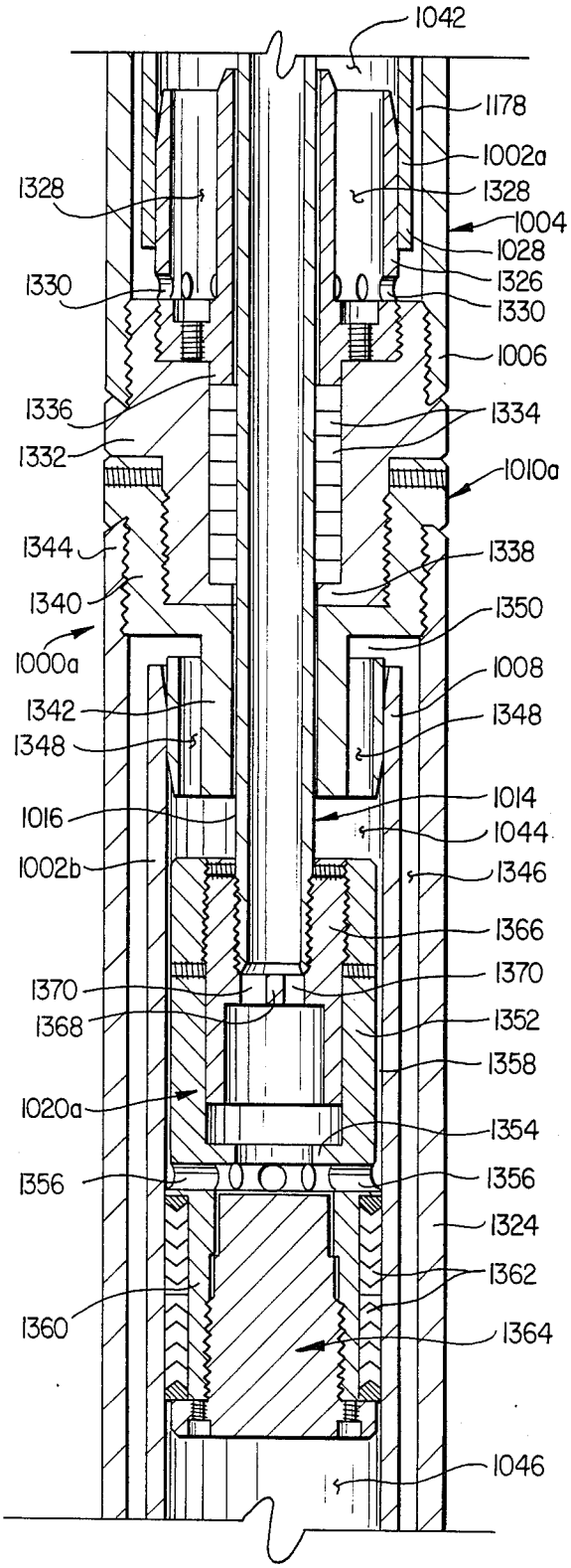
FIGS. 22A and 22B are cross-sectional views through longitudinal portions of a modified lower half of the pump illustrated in FIGS. 17A and 17B.
Figure 22B:
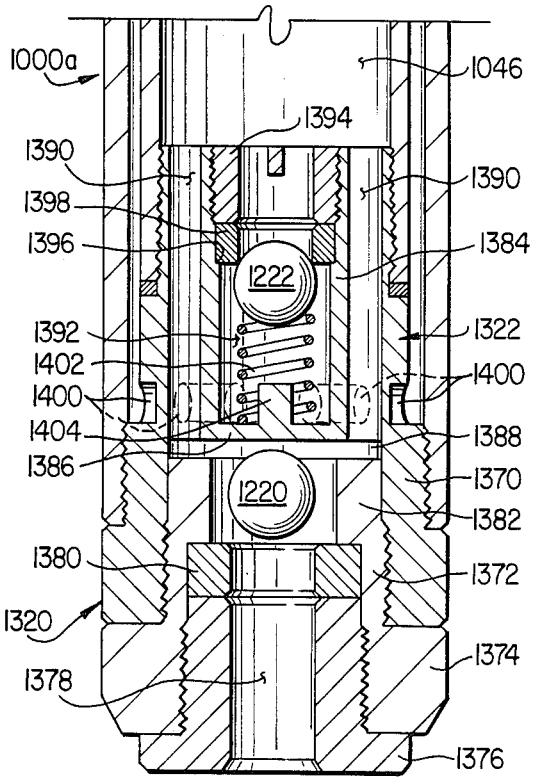

Cross-sectionally illustrated in FIGS. 22A and 22B are lower longitudinal sections of an alternate embodiment $\mathbf{1000}_a$ of the pump 1000. Pump $\mathbf{1000}_a$ is provided with a modified divider assembly $\mathbf{1010}_a$, a modified lower piston assembly $\mathbf{1020}_a$ connected to the lower end of the piston tube 1016, a modified inlet end portion 1320, a stationary valve assembly 1322 and a lower shell section 1324. Above its modified divider assembly $\mathbf{1010}_a$, the pump $\mathbf{1000}_a$ is identical in construction to the previously described pump 1000.

The divider assembly $\mathbf{1010}_a$ includes an annular barrel guide member 1326 which circumscribes the piston tube 1026 and is extended into the lower end portion 1028 of the upper barrel section $\mathbf{1002}_a$. Member 1326 has an annular passage 1328 formed therein which communicates with the driving fluid chamber 1042 and with the annular passage 1178 via a circumferentially spaced series of ports 1330. The member 1326 is threaded into an annular divider block member 1332 which is sealed to the piston tube 1026 by a series of annular packing washers 1334 retained between an annular skirt 1336 on member 1326 and an internal flange 1338 on the divider block 1332. The divider block 1332 is threaded into an annular divider adapter member 1340 having a downwardly projecting annular dome portion 1342 which is received in a non-threaded upper end portion 1008 of the lower barrel section $\mathbf{1002}_b$.

An upper end portion 1344 of the shell section 1324 is threaded onto the divider adapter 1340 and defines with the lower barrel section $\mathbf{1002}_b$ an annular, vertically extending passage 1346. The dome 1342 has formed therein a circumferentially spaced series of vertically extending passages 1348 which communicate with the production fluid delivery chamber 1044 at their lower ends, and communicate at their upper ends with the annular passage 1346 via an annular passage 1350 defined between the dome 1342 and the balance of the divider adapter 1340.

The lower piston assembly 1020$_a$ includes an annular piston body 1352 having an annular internal flange 1354 and a circumferentially spaced series of ports 1356 which are positioned immediately below the flange 1354 and communicate with the production fluid delivery chamber 1044 via a small annular passage 1358 defined between the piston body and the lower barrel section 1002$_b$. A lower end portion 1360 of the piston body 1352 is slidably sealed to the interior surface of the lower barrel section 1002$_b$ by a series of annular seal members 1362 and is closed by an annular plug member 1364 threaded thereinto. An annular piston lifter member 1366 is threaded into the piston body 1352 above the internal flange 1354 and has a cylindrical divider portion 1368 having formed therein a circumferentially spaced series of vertically extending holes 1370 which communicate with the interior of the piston tube 1016 and with the ports 1356 via the interiors of the piston body 1352 and the piston lifter 1366. As illustrated, the lower end of the piston tube 1016 is threaded into the piston lifter 1366 above the divider 1368. It should be noted that the valve balls 1220 and 1222 in the pump 1000$_a$ are relocated from the lower piston assembly to the stationary valve assembly 1322 which will now be described.

The stationary valve assembly 1322 includes a valve body member 1370 which is threaded into the lower end of the barrel section 1002$_b$. A lower end portion of the valve body member 1370 is threaded into an annular spacer member 1372 which is in turn threaded into the lower end of the shell section 1324. An annular valve cage member 1374 is threaded into the spacer member 1372, and an annular seat keeper member 1376 is threaded into the valve cage member 1374, the interior 1378 of the seat keeper member 1376 defining the well fluid inlet of the pump 1000$_a$. An annular lower valve seat 1380 is captively retained between the upper end of the seat keeper 1376 and an annular internal flange portion 1382 of the valve cage member 1374.

The upper end portion 1384 of the valve body member 1370 is of a generally cylindrical configuration and has a lower wall portion 1386 which is positioned slightly above the annular internal flange 1382 and defines therewith an annular space 1388 which communicates with the inlet passage 1378 via the interiors of the flange 1382 and the lower valve seat 1380. The upper end portion 1384 of the valve body 1370 has formed therethrough, adjacent its outer periphery, a circumferentially spaced series of vertically extending passages 1390 which intercommunicate the production fluid intake chamber 1046 with the annular passage 1388. Such upper end portion 1384 also has formed therein a cylindrical, vertically extending central recess 1392 having an annular upper seat keeper member 1394 threaded into an upper end portion thereof. Captively retained between the lower end of the seat keeper 1394 and an annular ledge portion 1396 of the upper end portion 1384 is an annular upper valve seat 1398. A circumferentially spaced series of ports 1400 extend outwardly from the recess 1392 between the vertical passages 1390 and into the vertically extending annular passage 1356 defined between the lower barrel section 1002$_b$ and the lower shell section 1324.

The upper valve ball 1222 is captively retained within the recess 1392 for vertical movement toward and away from the upper valve seat 1398 and is biased upwardly toward seating engagement with the valve seat 1398 by a valve spring 1402 whose lower end circumscribes a cylindrical boss 1404 projecting upwardly from the lower wall 1386. The lower valve ball 1220 is captively retained within the interior flange 1382 for vertical movement between the lower wall 1386 and the lower valve seat 1380.

During upward movement of the piston means 1014 the upper valve ball 1222 is seated on its valve seat 1398, and the lower valve ball 1220 is lifted off of its valve seat 1380. Accordingly, during such upward travel of the piston means, well fluid is drawn inwardly through the inlet 1378 and into the expanding production fluid intake chamber 1046. Simultaneously, production fluid in the production fluid delivery chamber 1044 is forced downwardly through the narrow annular passage 1358, radially inwardly through the lower piston ports 1356, and upwardly into the interior of the piston tube 1016 (via the ports 1370 in the cylindrical divider member 1368) for ultimate discharge from the pump 1000$_a$.

During downward travel of the piston means 1014, the upper valve ball 1222 is forced downwardly off its valve seat 1398 and the lower valve ball 1220 is reseated on the lower valve seat 1380. Accordingly, production fluid in the production fluid intake chamber 1046 is forced downwardly into the central recess 1392, laterally outwardly through the ports 1400 into the vertically extending annular passage 1346, upwardly through passage 1346, laterally inwardly through the annular passage 1350, downwardly through the vertical passages 1348 of the dome 1342 and into the production fluid delivery chamber 1044 to refill such chamber.

From the foregoing it can be seen that the valve balls 1220 and 1222 together with their associated valve seats in pumps 1000 and 1000$_a$ define in such pumps a duality of reverse acting one way valve means which are maintained in a fixed relative positional relationship during operation of such pumps. As used herein, the term "reverse acting" means that when one of the valves is opened the other one is closed, and vice versa. In the case of pump 1000 the two valve means or ball check valves are carried by the piston means for movement therewith. In the case of the pump 1000$_a$ just described, the two valve means or ball check valves are maintained in a fixed relationship relative to the pump barrel by means of the stationary valve assembly 1322.

The pumps 1000 and 1000$_a$ offer a variety of operating advantages over conventional downhole well pumps—particularly those of the sucker rod type. For example, in sucker rod pump systems there is considerable system "stretch" during operation. This system stretch, which occurs primarily in the greatly elongated actuating rod that is alternately subjected to tension and compression forces, is mechanical in nature and, importantly, occurs "downhole" where it is difficult, if not impossible, to precisely adjust and/or compensate for. This mechanical, downhole stretch problem is essentially eliminated in the present invention by virtue of the fact that the piston tubes of pumps 1000 and 1000$_a$ (like the piston tubes of various other pumps disclosed herein) are relatively short compared to the greatly elongated driving fluid and production fluid pipes, and are maintained in a constant state of tension during pump operation.

The substantial elimination of mechanical stretch also permits the compression ratio of pumps 1000 and 1000$_a$, as in the case of other pumps disclosed herein, to be optimized and precisely calibrated during the above-ground pump assembly process. More specifically, unlike the situation in sucker rod-type pumps, there is simply no guesswork involved as to where the lower piston will be, relative to the pump inlet, at the lower limit of its downstroke. Its precise downstroke location relative to the inlet is established during the above-ground pump assembly process, and is reliably maintained during the downhole operation of the pump.

This is not to say that there is no system "stretch" in the hydraulically driven pump systems of the present invention-such stretch indeed exists. However, and very importantly, such stretch is not mechanical but is hydraulic and may be easily and rapidly compensated for, and controlled above-ground, by making suitable adjustments to the power transfer system. To facilitate and augment this hydraulic adjustment ability, using the power transfer system 1230 as an example, it is preferable that the driving fluid displacement capacity of the power transfer system be larger than the sum of the mechanical displacement volume of the well pump plus the compressability volume of the driving fluid in the driving fluid pipe arising from the pressure force interaction between the power transfer system and the well pump. Such compressability volume includes the actual compression volume of the driving fluid plus the pressure-caused "bulge" volume of the driving fluid pipe.

Figure 23:
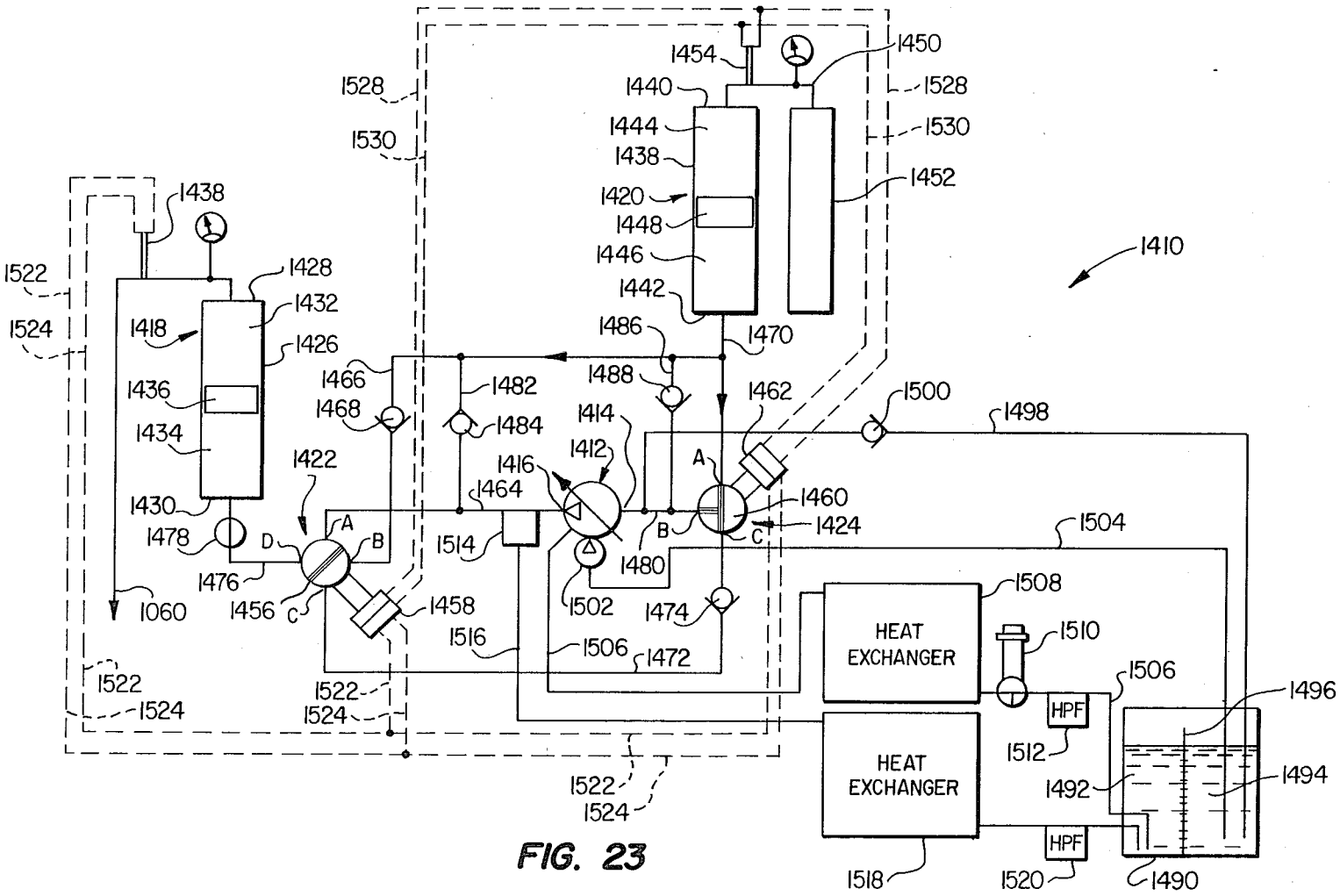
FIG. 23 is a schematic diagram of an alternate embodiment of the power transfer system of FIG. 20.

As previously mentioned, the power transfer system 1230 depicted in FIG. 20 utilizes a portion of the potential energy stored in the piston means 1014 of pump 1000 or $\mathbf{1000}_a$ to assist in driving the system pump 1248 during the "downstroke" half of its cycle in which the well pump piston means 1014 are falling through their downstroke. Illustrated in FIG. 23 is a power transfer system 1410 which constitutes an alternate embodiment of the previously described power transfer system 1230. System 1410 utilizes a variable volume, closed loop reversible driving fluid pump 1412, with high pressure capability on both sides thereof, having an inlet 1414 and an outlet 1416. As will be seen, the system 1410 utilizes stored potential energy in the well pump piston means 1014 to assist in driving the pump 1412 during both the upstroke and downstroke portions of its cycle, to thereby reduce the power consumption of its driving motor (not shown).

System 1410 includes a first accumulator or isolator 1418, a second accumulator 1420, a reversible four-way valve 1422, and a reversible three-way valve 1424. Accumulator 1418 has a cylindrical housing 1426 which has upper and lower ends 1428, 1430 and an interior divided into upper and lower chambers 1432, 1434 by a free piston 1436 disposed therein for movement between the upper and lower housing ends 1428, 1430. An upper end of the driving fluid pipe 1060 communicates with the upper housing chamber 1432 and has a pressure sensing switch 1438 operatively positioned therein. Each of the housing chambers 1432, 1434 are filled with driving fluid.

The second accumulator 1420 has a cylindrical housing 1438 having upper and lower ends 1440, 1442 and an interior which is divided into upper and lower chambers 1444, 1446 by a free piston 1448 disposed therein for movement between the upper and lower housing ends 1440, 1442. The upper chamber 1442 is filled with a pressurized gas such as nitrogen which is supplied thereto via a gas supply conduit 1450 interconnected between the upper housing chamber 1440 and a suitable gas storage tank 1452. A pressure sensing switch 1454 is operatively installed in the conduit 1450. The lower housing chamber 1446 is filled with driving fluid.

The four-way valve 1422 has four ports A, B, C and D, and a schematically depicted internal member 1456 which is movable by a switch 1458 between an upstroke position (illustrated in FIG. 23) in which ports A and D communicate, and ports B and C communicate, and a downstroke position (not shown in FIG. 23) in which ports A and B communicate and ports C and D communicate.

The three-way valve 1424 has three ports A, B and C and a schematically depicted internal member 1460 which is movable by a switch 1462 between an upstroke position (shown in FIG. 23) in which ports A and C communicate with each other and with port B, and a downstroke position (not shown in FIG. 23) in which ports B and C communicate, and fluid flow through port A is precluded.

The valve 1422 is interconnected to the balance of the system 1410 by means of a conduit 1464 interconnected between its port A and the outlet 1416 of pump 1412; a conduit 1466 having a check valve 1468 therein and interconnected between port B of valve 1422 and a conduit 1470 extending between housing chamber 1446 and port A of valve 1424; a conduit 1472 extending between its port C and port C of valve 1424 and having a check valve 1474 therein; and a conduit 1476 interconnected between its port D and the lower chamber 1434 of the accumulator housing 1426 and having a manual on/off valve 1478 installed therein.

Port B of the three-way valve 1424 is connected to the inlet 1414 of pump 1412 by a conduit 1480. The conduits 1464 and 1466 are interconnected by a conduit 1482 having a check valve 1484 operatively installed therein. Similarly, the conduits 1466 and 1480 are interconnected by a conduit 1486 having a check valve 1488 operatively installed therein.

The power transfer system 1410 is also provided with a driving fluid reservoir 1490 whose driving fluid-filled interior is divided into chambers 1492 and 1494 by a suitable perforated baffle 1496. A pump inlet conduit 1498, having an anti-cavitation check valve 1500 installed therein, is extended between the reservoir chamber 1494 and the conduit 1480. The pump 1412 has operatively connected thereto a conventional charge pump 1502 having an inlet conduit 1504 which extends into the reservoir chamber 1494. Charge pump 1502 also has a discharge conduit 1506 which is extended into the reservoir chamber 1492 via a pump case heat exchanger 1508, a manual filler valve 1510, and a high pressure filter (HPF) 1512. A conventional pressure relief valve 1514 is installed in the pump discharge conduit 1464 and has a fluid vent conduit 1516 which is extended into the reservoir chamber 1492 via a system relief heat exchanger 1518 and a high pressure filter (HPF) 1520.

With the well pump piston means 1014 at the bottom of their downstroke, the first accumulator piston 1436 is at the bottom of its stroke, the second accumulator piston 1448 is at the upper end of its stroke, and the internal valve members 1456, 1424 of the valves 1422, 1424 have been switched (in a manner subsequently described) to their illustrated upstroke positions. The system pump 1412 draws driving fluid from the reservoir chamber 1494 via the inlet conduit 1498 and check valve 1500 and its inlet 1414, and discharges the driving fluid through its outlet 1416 into the first accumulator housing lower chamber 1434 via the discharge conduit 1464, the ports A and D of valve 1422, and the conduit 1476. Driving fluid forced into the housing chamber 1434 forces the piston 1436 upwardly to thereby force driving fluid in the upper chamber 1432 into and downwardly through the driving fluid pipe 1060. Driving fluid forced downwardly through pipe 1060 forces the well pump piston means 1014 upwardly. During at least an initial portion of this upstroke phase of the operation of pump 1412, the gas pressure in the second accumulator housing upper chamber 1444 forces the piston 1448 downwardly to thereby force driving fluid in chamber 1446 through the pump 1412 via conduit 1470, ports A and B of valve 1424, and conhduit 1480. As will be seen, the piston 1448 has previously been moved upwardly in housing 1438 by a unique transfer of potential energy from the well pump piston means 1014 to the second accumulator 1420. Additional driving fluid from the lower housing chamber 1446 of accumulator 1420 is caused to bypass the pump 1412 and be forced directly into discharge conduit 1464 via conduit 1470, the conduit 1466, the conduit 1482 and the check valve 1484. This driving fluid which bypasses the system pump 1412 is forced directly into the lower housing chamber 1434 of the first accumulator 1418 via the conduit 1464, ports A and D of valve 1422, and the conduit 1476. As the accumulator piston 1448 approaches the lower limit of its downstroke, the flow rate of driving fluid from chamber 1446 which is forced through and around the pump 1412 gradually lessens and the inlet flow rate through conduit 1498 increases.

As the well pump piston means 1014 approach the top of their upstroke, the first accumulator piston 1436 approaches the top of its upstroke, and the second accumulator piston 1448 approaches the bottom of its downstroke. When the first accumulator piston 1436 reaches the top of its upstroke, the pressure in the driving fluid pipe 1060 reaches a predetermined value and activates the pressure sensing switch 1438. Via electrical leads 1522, 1524 the pressure switch 1438 activates the valve switches 1458, 1462 to reverse the internal valve members 1456, 1460 to their "downstroke" positions. This permits the well pump piston means 1014 to fall through their downstroke as previously described.

Such fall of the well pump piston means forces driving fluid into the first accumulator housing chamber 1432 to thereby drive the accumulator piston 1436 downwardly. Downward movement of the piston 1436 forces driving fluid from the lower chamber 1434 into and through the system pump 1412 via conduit 1476, ports D and C of valve 1422, conduit 1472, check valve 1474, ports C and B of valve 1424, and conduit 1480. In this manner, a portion of the potential energy stored in the well pump piston means is utilized to directly drive the system pump 1412 during the downstroke portion of its cycle to thereby reduce its power consumption.

However, an additional portion of the such potential energy is transferred to the second accumulator 1420 in the following manner. A portion of the driving fluid which is flowed leftwardly through conduit 1480 during the initial phase of the downstroke cycle of pump 1412 is flowed upwardly through conduit 1486 and the check valve 1488 into the lower accumulator chamber 1446 via the conduit 1466 and the conduit 1470. Additionally, all of the driving fluid forced through the pump 1412 into discharge conduit 1464 is also forced into the accumulator housing chamber 1446 via ports A and B of valve 1422, the conduit 1466 and the check valve 1468, and the conduit 1470. Entry of the driving fluid into the accumulator chamber 1446 drives the piston 1448 upwardly in the housing 1438 against the pressure of the gas in the upper chamber 1444. In this manner, a portion of the stored potential energy in the well pump piston means is also transferred to the second accumulator 1420.

As the well pump piston means reach the lower limit of their downstroke the accumulator piston 1436 reaches the lower limit of its downstroke and the accumulator piston 1448 reaches the upper limit of its upstroke and the downstroke cycle of the system 1410 is completed. At this point, the pressure in the upper housing chamber 1444 reaches a predetermined upper level to thereby energize the pressure sensor 1454. Via electrical leads 1528 and 1530, the pressure switch 1454 then activates the valve switches 1458, 1462 to reverse the valve members 1456, 1460 of valves 1422, 1424 to their "upstroke" positions, thereby causing the system 1410 to initiate its upstroke cycle again.

To broadly summarize the interaction between the well pump and the power transfer system 1410, during the downstroke cycle of the system, a first portion of the stored potential energy in the well pump piston means is used to directly drive the system pump 1412, while a second portion of such stored potential energy is transferred to the second accumulator 1420. During the upstroke cycle of the system 1410, a first portion of the potential energy stored in the second accumulator 1420 is used to directly drive the first accumulator 1418, while a second portion of the stored potential energy is used to directly drive the system pump 1412. In this unique manner, a significant portion of the potential energy of the well pump piston means is utilized to reduce the power consumption of the system pump 1412 during both its upstroke and downstroke cycles.

Although preferred embodiments of the present invention have been described in detail herein those skilled in the art will recognize that various substitutions and modifications may be made to the various components of the invention without departing from the scope and spirit thereof as recited in the appended claims.

What I claim is:

1. A hydraulically operated downhole well pump system for lifting production fluids from a wellbore to a wellhead, comprising:

a positive displacement pump adapted to be disposed in said wellbore at a predetermined depth, said pump including an elongated housing, piston means disposed in said housing and defining in part a production fluid chamber and a driving fluid chamber, and valve means for admitting production fluid to said production fluid chamber from said wellbore;

first conduit means extending between said pump and a wellhead and in fluid flow communication with said driving fluid chamber, said first conduit means being at least partially filled with pump driving fluid;

second conduit means extending between said pump and said wellhead and in fluid flow communication with said production fluid chamber for conducting production fluid from said pump;

means for effecting oscillatory displacement of driving fluid in said first conduit means to cause said piston means of said pump to displace production fluid from said production fluid chamber through said second conduit means to said wellhead; and accumulator means in communication with said first and second conduit means, respectively, for maintaining a predetermined minimum pressure of the fluids in said conduit means to minimize flow variations of the fluids in said conduit means due to compression of said fluids, respectively.

2. A hydraulically operated downhole well pump system for lifting production fluids from a wellbore to a wellhead, comprising:

a positive displacement pump adapted to be disposed in said wellbore at a predetermined depth, said pump including an elongated housing, pump piston means disposed in said housing and defining, in part, a pump production fluid chamber and a pump driving fluid chamber, and valve means for admitting production fluid to said pump production fluid chamber from said wellbore;

means in flow communication with said driving fluid chamber for urging driving fluid to effect reciprocation of said piston means;

first conduit means extending between said pump and said wellhead and in fluid flow communication with said pump production fluid chamber for conducting production fluid from said pump; and means for effecting displacement of production fluid in said first conduit means to cause said pump piston means to reciprocate to displace production fluid from said pump production fluid chamber through said first conduit means to said wellhead, said housing including a first partition interposed in cylinder bore means formed in said housing, said pump piston means including an elongated tubular piston rod extending through said first partition in slidable fluid sealing relationship thereto, a first piston connected to said piston rod and dividing said bore means into a first driving fluid chamber and a production fluid transfer chamber, a second piston connected to said piston rod at a point spaced from said first piston and defining a production fluid delivery chamber with said bore means, passage means in said pump piston means for conducting production fluid to and from said delivery chamber, and one way valve means interposed in said passage means in such a way as to permit transfer of production fluid to said delivery chamber and from said delivery chamber to said transfer chamber in response to said piston means being urged through a reciprocal stroke cycle in said housing, said pump including a second partition interposed in said housing and spaced from said first partition, said piston means including a third piston connected to said piston rod and interposed in said bore means between said partitions and dividing said bore means between said partitions into a second driving fluid chamber and a second production fluid delivery chamber, said second delivery chamber being in communication with said passage means.

3. The pump system set forth in claim 2 wherein:

said pump includes an elongated draft tube extending from said second piston in slidable sealed engagement through a lower head member of said housing, said draft tube including passage means in communication with said passage means in said pump piston means for conducting production fluid from said wellbore to said first and second delivery chambers.

4. The pump system set forth in claim 2 wherein:

said pump includes a third driving fluid chamber formed in said housing between said lower head member and said second piston.

5. A positive displacement downhole well pump for pumping production fluid from a well, said pump comprising an elongated pump housing, partition means interposed between opposed cylinder bore means formed in said pump housing, piston means disposed in said pump housing including an elongated tubular piston rod extending through said partition means in slidable fluid sealing relationship thereto, a first piston connected to said piston rod and dividing one of said bore means into a driving fluid chamber and a production fluid transfer chamber, means forming a port in said pump housing opening into said driving fluid chamber for communicating driving fluid to said driving fluid chamber, a second piston connected to said piston rod at a point spaced from said first piston and forming with the other of said bore means a production fluid delivery chamber, means for conducting production fluid to to said delivery chamber from the exterior of said pump housing, passage means in said piston means for conducting production fluid to and from said delivery chamber, one way valve means interposed in said passage means in such a way as to permit transfer of production fluid to said delivery chamber and from said delivery chamber to said transfer chamber in response to said piston means being urged through a reciprocal stroke cycle in said pump housing, and passage means in said pump housing for conducting production fluid from said transfer chamber to a production fluid conduit connected to said pump, said pump including a second partition interposed in said housing and spaced from said first partition, said piston means including a third piston connected to said piston rod and interposed in said bore means between said partitions and dividing said bore means between said partitions into a driving fluid chamber and a second production fluid delivery chamber, said second delivery chamber being in communication with said passage means.

6. The pump set forth in claim 5 wherein:

said pump includes an elongated draft tube extending from said second piston in slidable sealed engagement through a lower head member of said pump housing, said draft tube including passage means in communication with said passage means in said pump piston means for conducting production fluid from said wellbore to said first and second delivery chambers.

7. The pump set forth in claim 6 wherein:

said pump includes a third driving fluid chamber formed in said housing between said lower head member and said second piston.

8. A downhole well pump operable to lift production fluid from a wellbore, comprising:

an elongated housing having an inlet opening for receiving production fluid from said wellbore, and an outlet opening for discharging fluid from said housing;

piston means disposed in said housing and dividing the interior thereof into first and second chambers;

means for utilizing an external power source to cause longitudinal reciprocation of said piston means within said housing;

passage means intercommunicating said inlet opening and said first chamber, said first chamber and said second chamber, and said second chamber and said outlet opening;

first and second reverse acting one way valve means, operatively disposed in said passage means, for blocking and unblocking portions of said passage means during reciprocation of said piston means in a manner causing the reciprocating piston means to alternately force production fluid from said second chamber through said passage means toward said outlet opening and force production fluid from said first chamber into said second chamber; and means for maintaining said first and second valve means in a fixed relative positional relationship during operation of said well pump, said means for maintaining said first and second valve means in a fixed relative positional relationship comprising means for fixedly securing said first and second valve means to said housing.

9. The well pump of claim 8 wherein each of said first and second valve means is a ball check valve.

10. The well pump of claim 9 wherein said means for fixedly securing said first and second valve means to said housing are positioned adjacent said inlet opening of said housing.

11. The well pump of claim 8 wherein:

said housing has a discharge conduit connected thereto over said outlet opening, and said discharge conduit has one way outlet valve means operatively connected therein, said outlet valve means being operative to maintain a predetermined minimum fluid pressure in an outlet portion of said passage means during operation of said well pump.

12. The well pump of claim 11 wherein:

said one way outlet valve means comprise a spring loaded ball check valve.

13. A hydraulically operated downhole well pump system for lifting production fluids from a wellbore to a wellhead, comprising:

a positive displacement pump adapted to be disposed in said wellbore at a predetermined depth, said pump including an elongated housing, pump piston means disposed in said housing and defining, in part, a pump production fluid chamber and a pump driving fluid chamber, and valve means for admitting production fluid to said pump production fluid chamber from said wellbore;

means in flow communication with said driving fluid chamber for urging driving fluid to effect reciprocation of said piston means;

first conduit means extending between said pump and said wellhead and in fluid flow communication with said pump production fluid chamber for conducting production fluid from said pump; and means for effecting displacement of production fluid in said first conduit means to cause said pump piston means to reciprocate to displace production fluid from said pump production fluid chamber through said first conduit means to said wellhead, said means for urging driving fluid including second conduit means forming a column of driving fluid, said second conduit means being connected to means for effecting displacement of said driving fluid to reciprocate said piston means, said driving fluid being of greater density than said production fluid and said piston means of said pump being provided with opposed faces of differential area, the face of lesser area being exposed to said driving fluid chamber.

14. The pump system set forth in claim 13 wherein:

said power transfer means includes first piston means forming a driving fluid chamber in communication with said second conduit means and means for reciprocating said first piston means through opposed strokes for displacing driving fluid from said power transfer means to said second conduit means and for displacing production fluid from said power transfer means to said first conduit means.

15. The pump system set forth in claim 14 including:

pressure limiting means in communication with said fluid delivery conduit for maintaining a predetermined pressure in said production fluid chamber of said power transfer means.

16. The pump system set forth in claim 14 wherein:

said power transfer means includes second piston means connected to said first piston means, said second piston means being disposed in a power fluid cylinder of said power transfer means and dividing said cylinder into opposed hydraulic fluid chambers;

hydraulic pump means operably connected to said hydraulic fluid chambers for delivering pressure fluid to said hydraulic fluid chambers to reciprocate said first piston means through said production fluid and driving fluid chambers, respectively, and control means for effecting delivery of hydraulic fluid to said hydraulic fluid chambers, alternately, to effect reciprocation of said piston means.

17. The pump system set forth in claim 16 wherein:

said hydraulic pump means comprises a reversible hydraulic pump operable to selectively reverse the flow of fluid through respective pump inlet and pump discharge lines interconnecting said hydraulic pump with said hydraulic fluid chambers.

18. The pump system set forth in claim 16 wherein:

said power transfer means comprises a frame including two opposed cylinders, said first piston means including a piston reciprocably disposed in one of said opposed cylinders and forming said production fluid chamber of said power transfer means, and another piston disposed in the other of said opposed cylinders and forming a driving fluid chamber in communication with said second conduit means, said power fluid cylinder is interposed between said opposed cylinders, and said pistons disposed in said opposed cylinders are interconnected with said second piston means for reciprocation in response to delivery of hydraulic fluid to said hydraulic fluid chambers, respectively.

19. The pump system set forth in claim 18 wherein:

said pistons in said opposed cylinders form with said opposed cylinders respective fluid isolation chambers for isolating said production fluid chamber and said delivery fluid chamber from said power fluid chambers, respectively, said isolation chambers being interconnected with each other and with a source of isolation fluid.

20. The pump system set forth in claim 16 wherein:

said control means includes sensor means for sensing the position of said first piston means for effecting reversal of the direction of movement of said first piston means to control the displacement of production fluid from said pump.

21. The pump system set forth in claim 20 including:

valve means interposed in said fluid delivery conduit and operable to restrict flow of production fluid through said fluid delivery conduit during displacement of production fluid from said production fluid chamber of said power transfer means by said first piston means to reciprocate said pump piston means.

22. The pump system set forth in claim 21 wherein:

said pump includes a lower head member including closure means cooperable with seat means on said second conduit means for closing a fluid drain passage in said second conduit means.

23. The pump system set forth in claim 21 wherein:

said pump includes valve means responsive to said pump being lifted by said first conduit means to drain fluid from said first conduit means.

24. Downhole well pump apparatus for lifting production fluid from a wellbore, comprising:

elongated hollow pump barrel means having a first end portion insertable into production fluid within said wellbore, and a second end portion;

partition means for dividing the interior of said pump barrel means into a first longitudinal portion positioned between said partition means and said first end portion of said pump barrel means, and a second longitudinal portion positioned between said partition means and said second end portion of said pump barrel means;

piston means disposed within said pump barrel means for reciprocating motion therein toward and away from said first end portion thereof, said piston means dividing said first longitudinal portion of said pump barrel means into first and second chambers, and dividing said second longitudinal portion of said pump barrel means into third and fourth chambers;

passage means for intercommunicating said first and second chambers, and said second and fourth chambers, and for defining an outlet extending from said fourth chamber through said second end portion of said pump barrel means for discharging production fluid from said fourth chamber, and an inlet into said first chamber from said first end portion of said pump barrel means for receiving production fluid from said well bore;

first and second reverse acting one way valve means, responsive to reciprocation of said piston means, for blocking and unblocking portions of said passage means in a manner such that during motion of said piston means toward said first end portion of said pump barrel means well bore production fluid in said first chamber is transferred therefrom into said second chamber through said passage means, and during motion of said piston means away from said first end portion of said pump barrel means well bore production fluid is drawn into said first chamber through said inlet, production fluid previously transferred into said second chamber from said first chamber is forced through said passage means toward said fourth chamber, and production fluid in said fourth chamber is forced through said passage means toward said outlet;

means for maintaining said first and second valve means in a fixed relative positional relationship during reciprocation of said piston means; and means for utilizing a driving fluid in said third chamber, and production fluid in said pump barrel means, to cause reciprocation of said piston means.

25. The apparatus of claim 24 wherein each of said first and second valve means is a ball check valve.

26. The apparatus of claim 24 wherein said piston means include first and second piston assemblies interconnected by a piston tube, and wherein said means for utilizing driving fluid and production fluid cooperate with said first and second piston assemblies to maintain said piston tube in tension during movement of said piston means toward and away from said first end portion of said pump barrel means.

27. The apparatus of claim 24 further comprising filter means operatively connected to said inlet, and wherein said piston means function, during motion thereof toward said filter means, to force a relatively small quantity of production fluid outwardly through said inlet to back flush said filter means.

28. The apparatus of claim 24 wherein said means for maintaining said first and second valve means in a fixed relative positional relationship comprise means for associating said first and second valve means with said piston means for reciprocation therewith.

29. The apparatus of claim 28 wherein said means for associating said first and second valve means with said piston means include means for connecting said first and second valve means to a portion of said piston means disposed within said first longitudinal portion of said pump barrel means.

30. The apparatus of claim 24 wherein said means for maintaining said first and second valve means in a fixed relative positional relationship comprise means for fixedly securing said first and second valve means to said pump barrel means.

31. The apparatus of claim 30 wherein said first and second valve means are positioned between said piston means and said inlet.

32. The apparatus of claim 24 wherein said means for utilizing a driving fluid in said third chamber include means for intermittently forcing into and withdrawing from said third chamber a quantity of driving fluid.

33. The apparatus of claim 32 wherein said piston means are positioned to reciprocate in an essentially vertical direction and wherein said means for intermittently forcing include driving fluid pump means, having an outlet coupled for fluid flow to said third chamber, for forcing said quantity of driving fluid into said third chamber to cause an upstroke of said piston means, and means for utilizing said piston means during their downstroke to assist in driving said driving fluid pump means.

34. The apparatus of claim 24 further comprising a head assembly connected to said second end portion of said pump barrel means and having a first opening extending axially therethrough and having a tapered surface portion, second passage means extending from said first opening into said third chamber, a production fluid pipe connected at one end to said head assembly and communicating with said fourth chamber through said outlet, and a driving fluid pipe extending centrally through said production fluid pipe, said driving fluid pipe having a pipe stabber member connected to an end thereof and received in said first opening in said head assembly, said tapered surface portion being positioned and configured to guide said pipe stabber member into said first opening of said head assembly as said driving fluid pipe is inserted through said production fluid pipe toward said head assembly.

35. The apparatus of claim 34 further comprising a drain port extending outwardly through said head assembly from said first opening therein and being blocked by said stabber member received in said first opening in said head assembly, whereby as said pipe stabber member is removed from said first opening said drain port is unblocked to permit fluid in said driving fluid pipe to be drained therethrough to allow said driving fluid pipe to be removed from said production fluid pipe in a dry condition.

36. The apparatus of claim 24 wherein said piston means comprise a first piston assembly disposed in said first longitudinal portion of said pump barrel means, a second piston assembly disposed in said second longitudinal portion of said pump barrel means, and a hollow piston tube interconnected between said first and second piston assemblies and slidably received in said partition means, said second piston assembly having formed therethrough a circumferentially spaced series of laterally extending ports positioned laterally inwardly of the interior surface of said pump barrel means and communicating with the interior of said piston tube, said piston tube and said ports defining a portion of said passage means, said second piston assembly further having means disposed longitudinally outwardly of said ports for impeding entry thereinto of abrasive material.

37. The apparatus of claim 36 wherein said means for impeding entry of abrasive material include a circumferentially spaced series of flutes circumferentially aligned with said ports and projecting laterally beyond them.

38. The well pump apparatus of claim 24 wherein:

said pump barrelmeans have an outlet opening in an upper end portion thereof, said outlet opening has a discharge conduit connected thereto, and said discharge conduit has a one way outlet valve means operatively connected therein, said outlet valve means being operative to maintain a predetermined minimum fluid pressure level in an outlet portion of said passage means during operation of said well pump apparatus.

39. The well pump apparatus of claim 38 wherein:

said one way outlet valve means comprise a spring loaded ball check valve.

* * * * *